US008602650B2

(12) United States Patent
Broering et al.

(10) Patent No.: US 8,602,650 B2
(45) **Date of Patent: *Dec. 10, 2013**

(54) BAG WITH IMPROVED FEATURES

(71) Applicant: The Glad Products Company, Oakland, CA (US)

(72) Inventors: Shaun T. Broering, Fort Thomas, KY (US); Karin L. Toerner, Cincinnati, OH (US); Charles B. Snoreck, Chicago Ridge, IL (US); Nancy M. Mack-Robles, Bolingbrook, IL (US); Matthew W. Waldron, Hamilton, OH (US); Robert W. Fraser, Lombard, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/689,243

(22) Filed: Nov. 29, 2012

(65) Prior Publication Data

US 2013/0094787 A1 Apr. 18, 2013

Related U.S. Application Data

(60) Continuation of application No. 13/291,736, filed on Nov. 8, 2011, now Pat. No. 8,348,511, which is a division of application No. 12/304,851, filed on Dec. 15, 2008, now Pat. No. 8,157,444.

(51) Int. Cl.

| | |
|---|---|
| ***B65D 33/28*** | (2006.01) |
| ***B65D 33/00*** | (2006.01) |
| ***B65D 30/02*** | (2006.01) |
| ***B65D 25/14*** | (2006.01) |

(52) U.S. Cl.
USPC ..... 383/75; 383/105; 383/118; 220/495.11

(58) Field of Classification Search
USPC ..... 383/75, 105, 118, 33; 220/495.11
See application file for complete search history.

(56) References Cited

U.S. PATENT DOCUMENTS

| | | | | |
|---|---|---|---|---|
| 3,119,549 | A * | 1/1964 | Schoen | 383/204 |
| 3,134,684 | A * | 5/1964 | Northrop et al. | 427/508 |
| 4,036,363 | A * | 7/1977 | Kugler | 206/526 |
| 5,265,962 | A * | 11/1993 | Ogawa et al. | 383/75 |
| 6,939,042 | B2 * | 9/2005 | Rusnak et al. | 383/71 |
| 6,994,469 | B2 * | 2/2006 | Sleight et al. | 383/43 |
| 7,946,765 | B2 * | 5/2011 | Melvan et al. | 383/43 |
| 8,157,444 | B2 * | 4/2012 | Broering et al. | 383/75 |
| 8,348,511 | B2 * | 1/2013 | Broering et al. | 383/75 |
| 2003/0142887 | A1 * | 7/2003 | Sleight et al. | 383/7 |

(Continued)

*Primary Examiner* — Jes F Pascua
(74) *Attorney, Agent, or Firm* — Thomas C. Feix

(57) ABSTRACT

The bag for receiving refuse may include a bag body, the bag body including an inside surface, an outside surface, and a rim defining a mouth. The bag may also include a first strip of material disposed on the inside surface of the bag body proximate the rim. The strip may include an inside surface, an outside surface that faces the inside surface of the body, a top edge, and a bottom edge. The bag may also include a front wall, a back wall, and a hem, the hem including a drawstring. The strip may include a printed design. The design could be letters, numbers, pictures, writing, or any other design. When the bag is inserted into a trash receptacle such that the rim of the bag is folded over the rim of the receptacle, the printed design is visible from outside the receptacle.

18 Claims, 49 Drawing Sheets

(56) References Cited

U.S. PATENT DOCUMENTS

2010/0046860 A1* 2/2010 Kent et al. ..... 383/75
2011/0052104 A1* 3/2011 Wilcoxen et al. ..... 383/75
2011/0052105 A1* 3/2011 Wilcoxen et al. ..... 383/75
2013/0089278 A1* 4/2013 Cobler ..... 383/75
2013/0094788 A1* 4/2013 Wilcoxen et al. ..... 383/75

* cited by examiner

BAG WITH IMPROVED FEATURES

CROSS-REFERENCE TO RELATED APPLICATIONS

This patent application is a continuation of copending U.S. patent application Ser. No. 13/291,736, filed Nov. 8, 2011, which is a division of U.S. patent application Ser. No. 12/304,851, filed on Dec. 15, 2008, now U.S. Pat. No. 8,157,444.

FIELD OF THE INVENTION

The present invention relates generally to bags, and more particularly to trash bags with improved structural and/or decorative features.

BACKGROUND OF THE INVENTION

Plastic trash bags have long been used to line trash receptacles. The trash bags encourage sanitary conditions by preventing the refuse from contacting the receptacle. Trash bags also provide a convenient way to remove trash from a receptacle for transport or disposal.

When trash bags are used to line a receptacle, they are most often folded around the rim of the receptacle. Thus, the upper portions of the bag are often visible on the upper part of the receptacle, which may be aesthetically unpleasant. A further problem associated with arranging trash bags around a receptacle rim is that a user often does not know how much of the trash bag should be folded over the rim. If too little bag is folded over the rim, the bag could slip off the rim and back into the receptacle when the bag receives refuse. If too much bag is folded over the rim, the full volume of the receptacle may not be utilized.

A further limitation of many known trash bags is presented by the fact that most users grip a bag by the top of the bag. This places increased stress on a bag at the rim and may cause bag failures to initiate at the bag rim. This problem is particularly acute with drawstring type bags, as the hem of the bag is subject to increased stresses by a user-manipulated drawstring.

BRIEF SUMMARY OF THE INVENTION

In one embodiment, the bag for receiving refuse may comprise a bag body, the bag body including an inside surface, an outside surface, and a rim defining a mouth. The bag may further comprise a first strip of material disposed on the inside surface of the bag body proximate the rim. The strip may include an inside surface, an outside surface that faces the inside surface of the body, a top edge, and a bottom edge.

In another embodiment, the bag may further comprise a front wall, a back wall, and a hem, the hem defining the rim. The hem may further define a passageway, which is at least partially enclosed. The hem may include a first opening and a second opening. The bag may comprise a drawstring, which is disposed within the passageway. The drawstring may be accessible via the first and second openings in the hem. The bag may also comprise a second strip of material disposed within the inside surface of the front wall of the bag proximate the rim. The second strip may include an inside surface, an outside surface, a top edge, a bottom edge, a first end, and a second end, wherein the outside surface faces the inside surface of the bag. The first strip may further include a first end and a second end.

In another embodiment, the strip or strips of the bag may include a printed design. The design could be letters, numbers, pictures, writing, or any other design. When the bag is inserted into a trash receptacle such that the rim of the bag is folded over the rim of the receptacle, the printed design could be visible from outside the receptacle.

In another embodiment, the bag may comprise a bag body including a first portion. The first portion may include an upper rim, which defines a mouth. The bag may further comprise a second portion disposed below the first portion, the second portion defining a closed bottom to the bag. The bag body may be thicker in the first portion than in the second portion.

In another embodiment, the bag may comprise a bag body, the bag body having an inside surface and an outside surface. The bag may comprise a rim, which defines a mouth. The bag may further comprise a hem that defines the rim. The hem may define a passageway, the passageway being at least partially enclosed. The hem may further include an inside surface, an outside surface, a first opening, and a second opening. The bag may also comprise a drawstring disposed within the passageway. The drawstring may be accessible via the first and second openings in the hem. The inside surface of the hem may include a printed design.

In another embodiment, the bag may comprise a bag body having an inside surface and an outside surface. The bag may comprise an undulating rim, the rim defining a mouth. The rim may include at least two flaps, wherein the flaps may be tied together to at least partially close the bag. The inside surface of the bag body may include a printed design proximate the rim.

BRIEF DESCRIPTION OF THE SEVERAL VIEWS OF THE DRAWING(S)

DETAILED DESCRIPTION OF THE INVENTION

Figure 1:
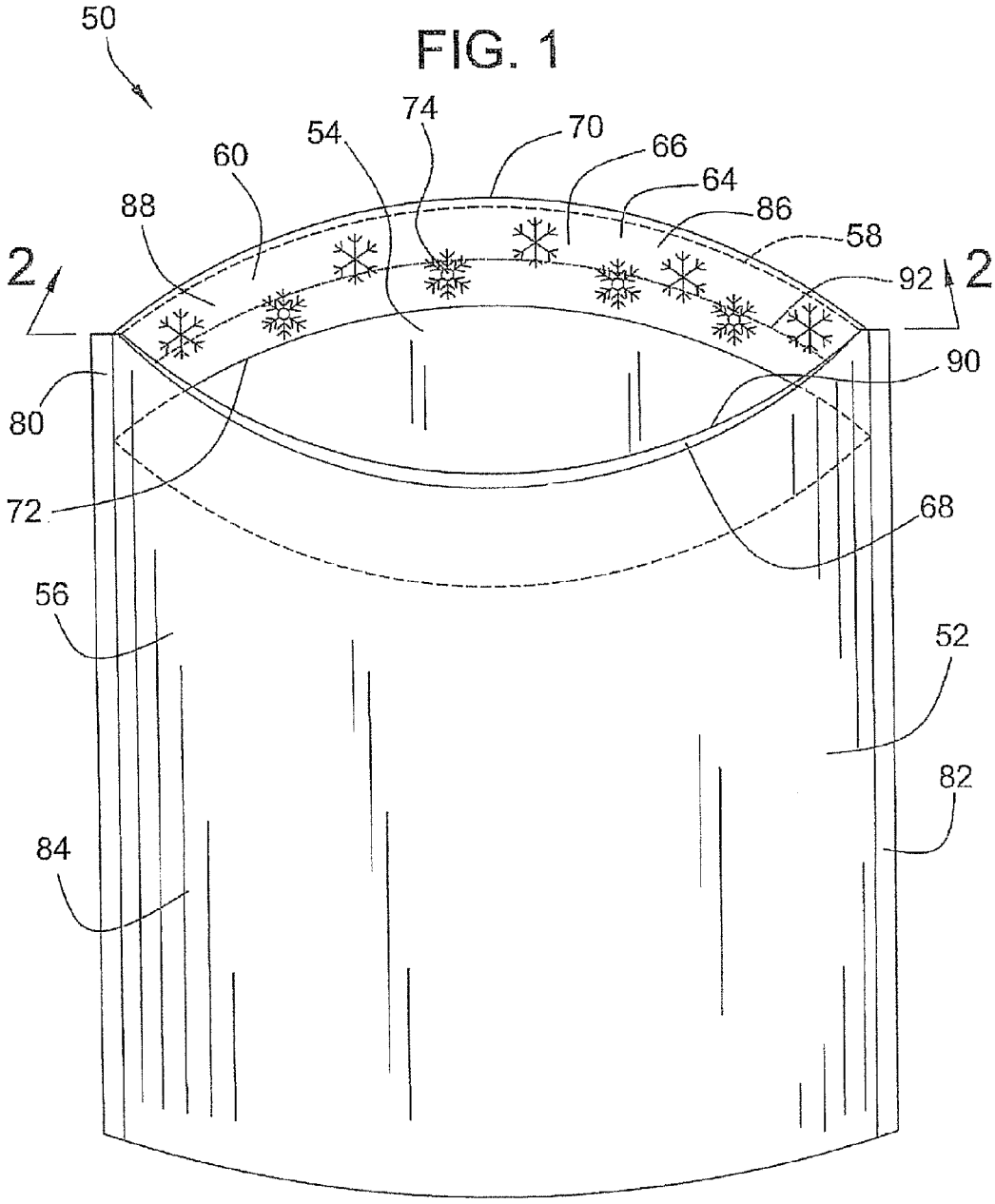
FIG. 1 is a perspective view of a bag.
Figure 2:
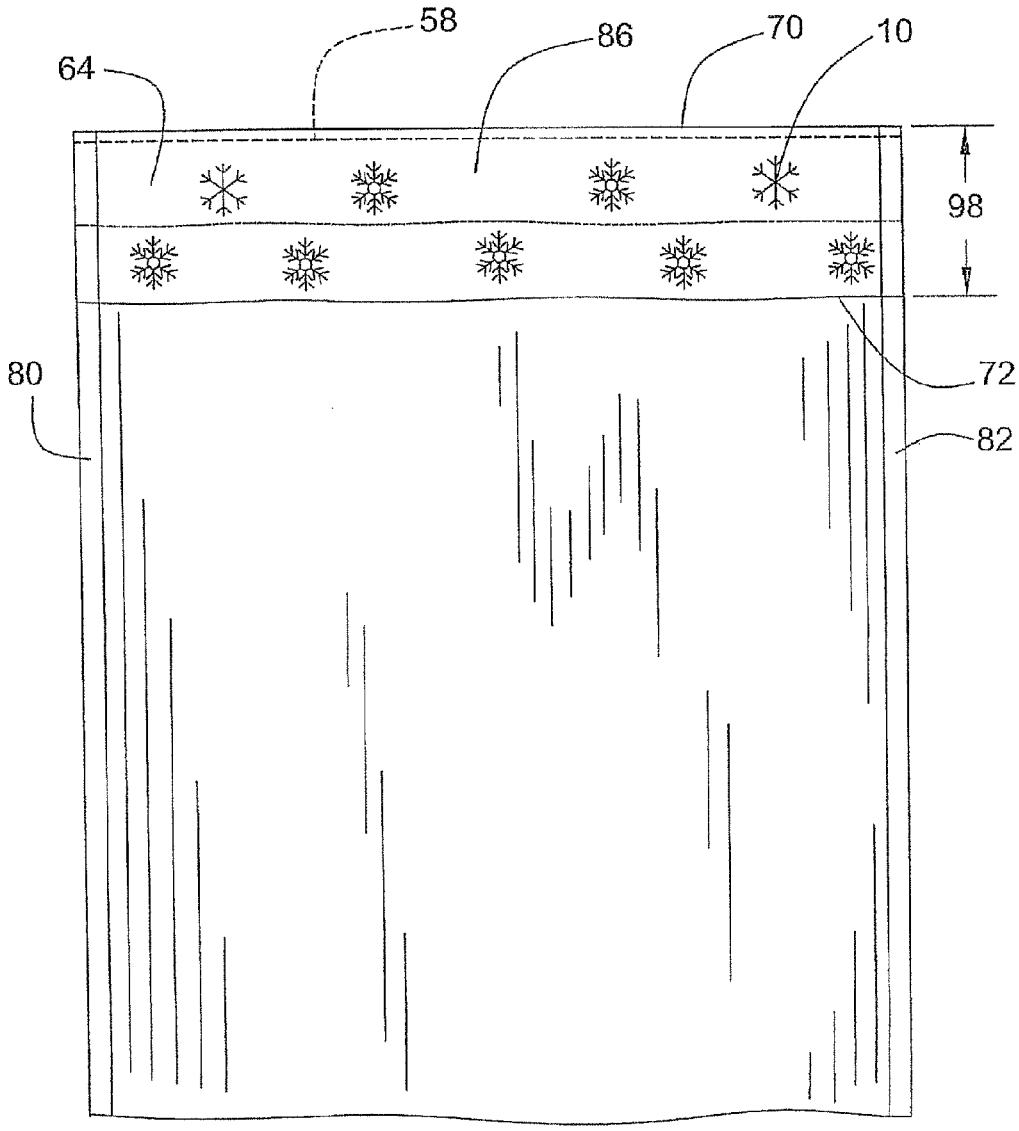
FIG. 2 is a cross sectional view taken along line 2-2 of the bag of FIG. 1.

Referring to FIG. 1, a trash bag 50 for receiving refuse may include a bag body 52, the bag body 52 including an inside surface 54, an outside surface 56, and a rim 58 defining a mouth 60. The bag may further comprise a strip 64 of material disposed on the inside surface 54 of the bag body 52 proximate the rim 58. The strip 64 may include an inside surface 66, an outside surface 68 that faces the inside surface 54 of the body 52, a top edge 70, and a bottom edge 72. The strip 64 may include a printed design 74 that is disposed on the inside surface 66, as shown in FIG. 2. The design could be letters, numbers, pictures, writing, or any other design. The strip 64 may be located proximate the rim 58 such that the top edge 70 of the strip 64 is slightly above the rim 58 of bag body 52. In other embodiments, the strip may have different properties than other portions of the bag such as, printed design, color, odor neutralizing agent, liquid absorbing agent, antimicrobial agent, fragrance releasing agent, thickness, strength, and/or material composition, as appropriate.

Referring to FIG. 1, the bag 50 may include a left side seam 80 and a right side seam 82. The bag 50 may include a front wall 84 and a back wall 86. Likewise, the strip 64 may include a first strip 88 and a second strip 90. The front wall 84, the back wall 86, the first strip 88, and the second strip 90 may all be joined at both the left and right seams 80, 82. The strip 64 may be joined to the inside surface 54 of the bag 50 along a first seal 92. The strip 64 may be unattached to the bag body 52 at both the top edge 70 and bottom edge 72. The seal 92 may be a heat seal. In other embodiments, the strips may be joined to the inside surface by other means of attachment, such as, for example, hot melts glues, contact adhesives, thermal bonding, ultrasonic bonding, film blocking, electrostatic pinning, van der Waals forces, and other adhesive or cohesive methods. In some embodiments, it may be desirable to apply an adhesive to at least one portion of the bag or the strip. For example, in some embodiments, adhesive chemical bonding, resin, powder bonding, or thermal bonding may be selectively applied to certain regions or all of the bag or the strip. For example, in the case of adhesive application, an adhesive can be applied in a continuous manner such as by slot coating or in a discontinuous manner such as by spraying, extruding, and the like. Discontinuous application of adhesive can be in the form of stripes, bands, droplets, and the like. Such an adhesive application may be in an amorphous pattern. In addition, the adhesive may be disposed within suitable structures, such as, shown in U.S. Pat. Nos. 5,662,758; 5,871,607; 5,965,224; 5,965,235; 5,968,633; 6,099,940; 6,156,363; 6,193,918; 6,194,062, U.S. Patent Application Publication Nos. 2003/0057206, 2005/0286817, all of which are incorporated by reference in their entirety herein.

Figure 3:
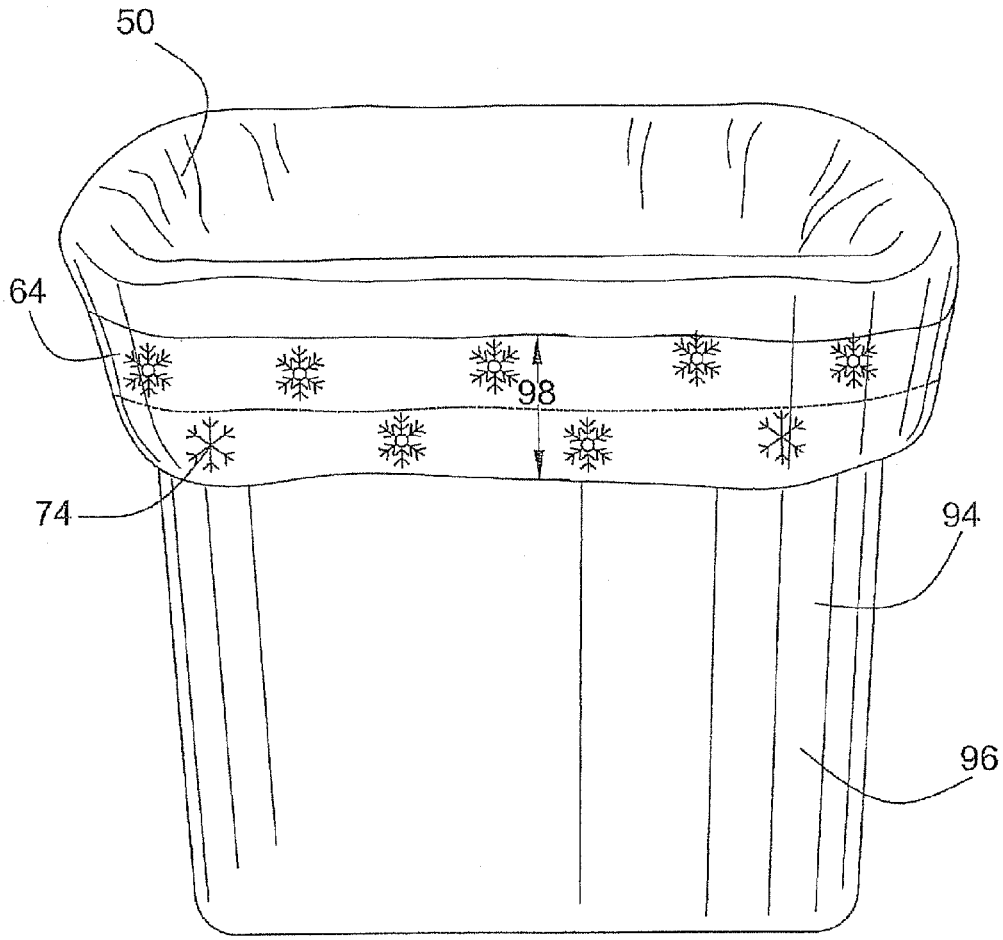
FIG. 3 is a perspective of the bag of FIG. 1 inserted into a trash receptacle.

Referring to FIG. 3, the bag 50 may be arranged inside a trash receptacle 94. As the upper portions of the bag 50 are folded over the rim of the trash receptacle 94, the strip 64 may become exposed on the outside 96 of the receptacle 94. Accordingly, the printed design 74 will be visible outside the receptacle 94, possibly even when a lid is placed over the receptacle. The width 98 of the strip 64 may correspond to a predetermined amount of the bag 50 to be folded over the rim of the trash receptacle 94 when the bag is being arranged in the receptacle 94. A user of the bag 50 may be instructed to this correlation in order to achieve optimal use of the bag 50. Optimal use of the bag may be when a sufficient amount of bag is folded over the rim of the receptacle such that it will not slip back inside the receptacle, but yet with sufficient bag remaining inside the receptacle to utilize the full trash receiving volume of the receptacle.

Figure 4:
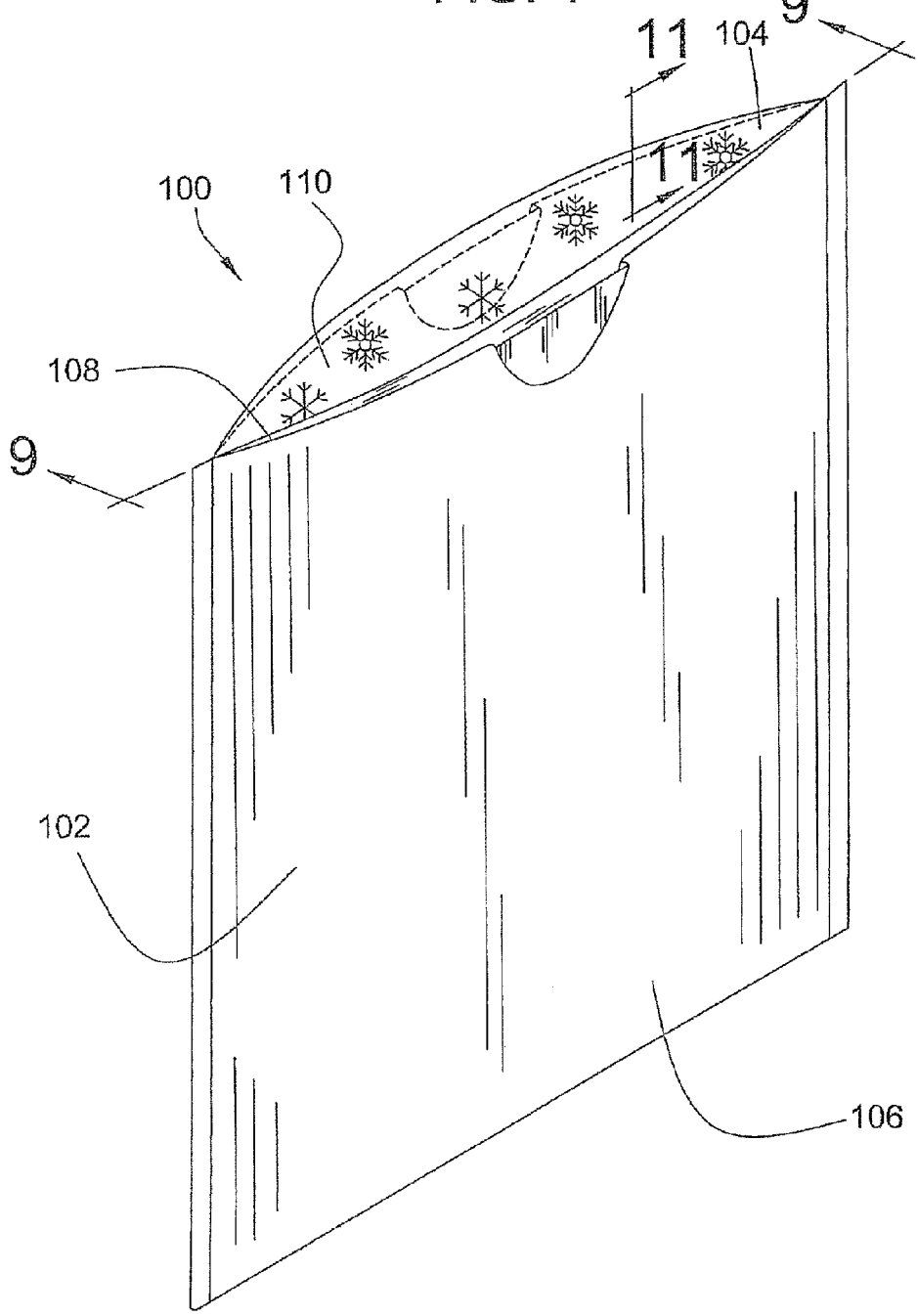
FIG. 4 is a perspective view of a drawstring bag.
Figure 5:
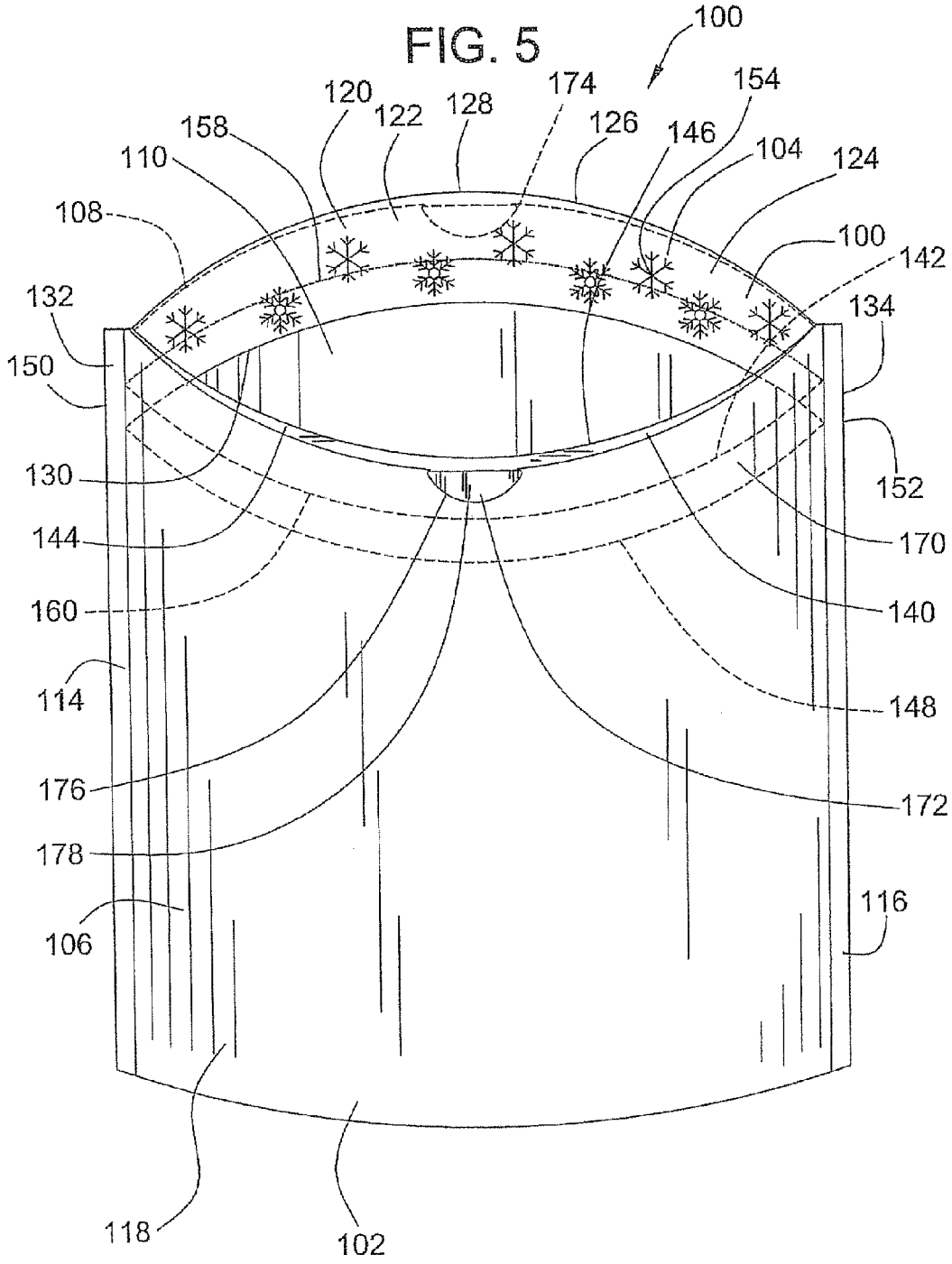
FIG. 5 is another perspective view of the bag of FIG. 4.
Figure 6:
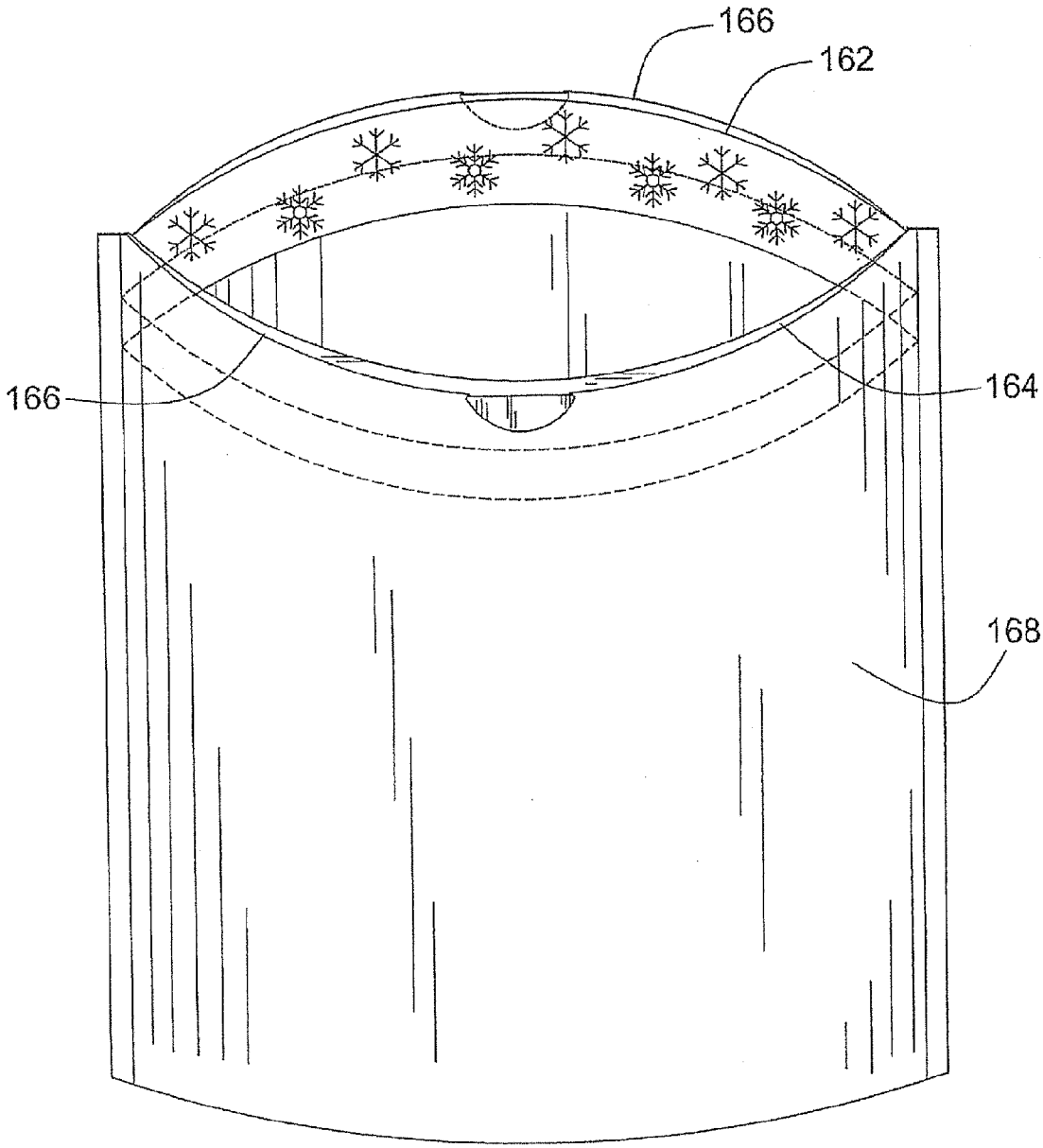
FIG. 6 is perspective view of another embodiment.
Figure 7:
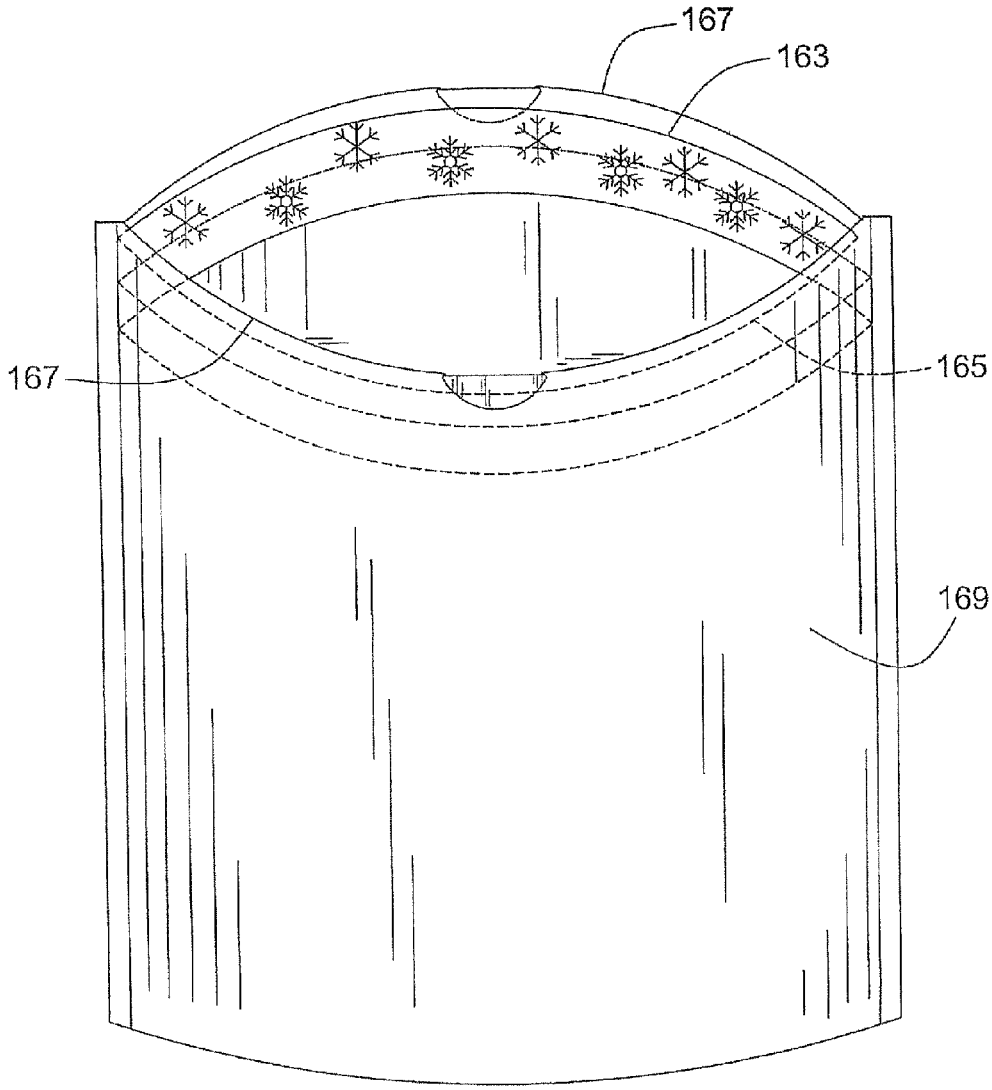
FIG. 7 is perspective view of another embodiment.
Figure 12:
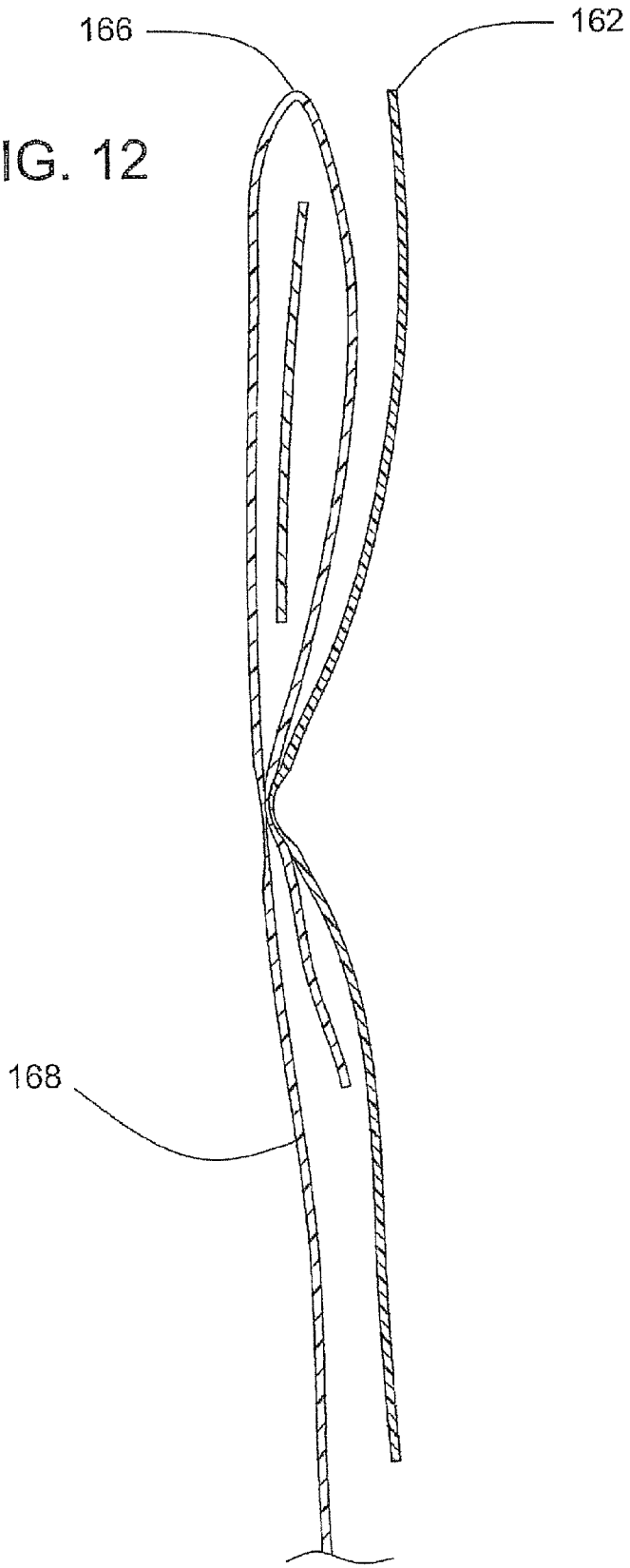
FIG. 12 is a cross sectional view taken along line 12-12 of the bag of FIG. 6.
Figure 13:
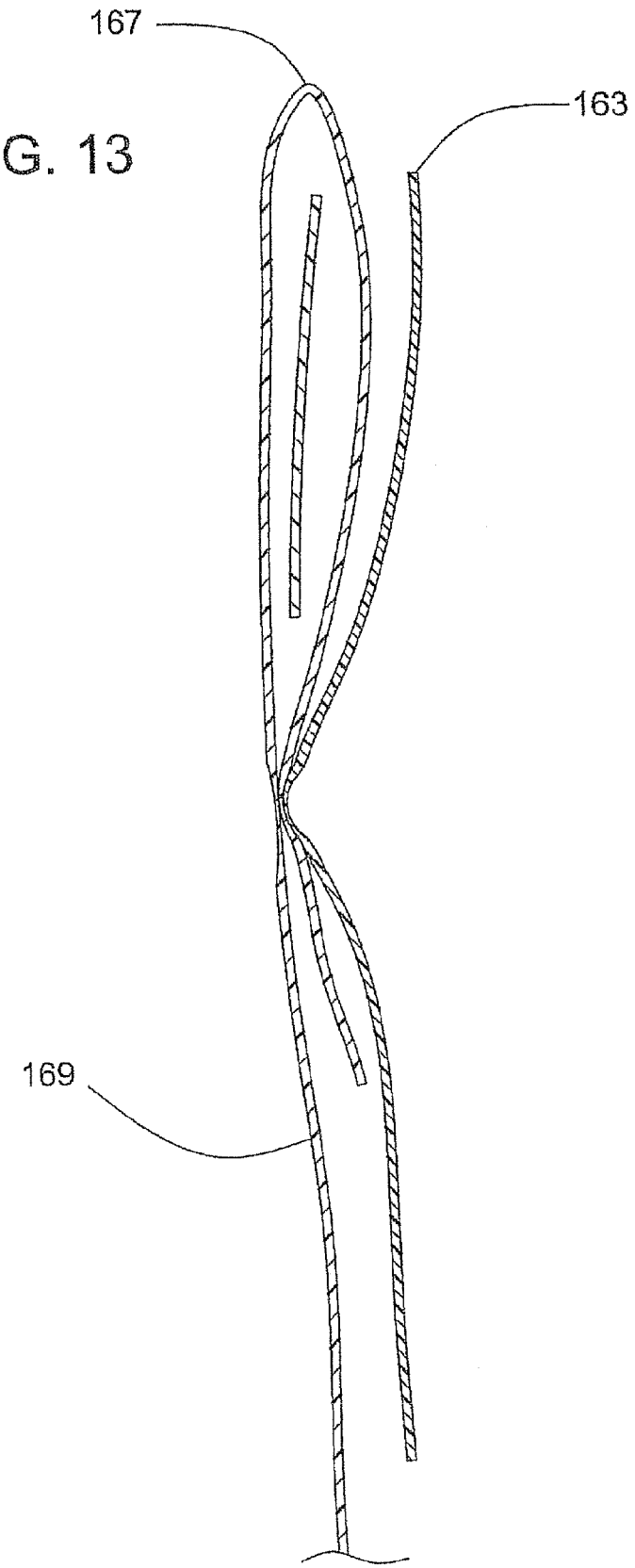
FIG. 13 is a cross sectional view taken along line 13-13 of the bag of FIG. 7.

Referring to FIG. 4 there is shown another embodiment. This embodiment includes a drawstring. The bag 100 for receiving refuse may comprise a bag body 102, the bag body 102 including an inside surface 104, an outside surface 106, and a rim 108 defining a mouth 110. Referring to FIG. 5, the bag 100 may include a left side seam 114 and a right side seam 116. The bag 100 may include a front wall 118 and a back wall 120. The bag 100 may include a first strip 122 of material disposed within the inside surface 104 of the back wall 120 of the bag 100 proximate the rim 108. The first strip 122 may include an inside surface 124, and outside surface 126, a top edge 128, a bottom edge 130, a first end 132, and a second end 134, wherein the outside surface 126 faces the inside surface 104 of the bag 100. The bag 100 may include a second strip 140 of material disposed within the inside surface 104 of the front wall 118 of the bag 100 proximate the rim 108. The second strip 140 may include an inside surface 142, and outside surface 144, a top edge 146, a bottom edge 148, a first end 150, and a second end 152, wherein the outside surface 144 faces the inside surface 104 of the bag 100. The front wall 118, the back wall 120, the first strip 122, and the second strip 140 may all be joined at both the left and right seams 114, 116. The first strip 122 may be joined to the inside surface 104 of the bag 100 along a first seal 158. The second strip 140 may be joined to the inside surface 104 of the bag 100 along a second seal 160. The strips 122, 140 may be unattached to the bag body 102 at both of their top edges 128,146 and their bottom edges 130, 148. The strips 122, 140 may be located proximate the rim 108 such that the top edges 128, 146 of the strips 122, 140 are slightly above the rim 108 of bag body 102. In other embodiments the top edges 162, 164, of the strips may be even with the rim 166 of the bag body 168, as shown in FIGS. 6 and 12. In other embodiments, the top edges 163, 164 of the strips may be lower than the rim 167 of the bag body 169, as shown in FIGS. 7 and 13.

Referring to FIG. 5, the strips may include a printed design 154. In other embodiments, the strip may have different properties than other portions of the bag such as, printed design, color, odor neutralizing agent, liquid absorbing agent, antimicrobial agent, fragrance releasing agent, thickness, strength, and/or material composition, as appropriate.

Figure 8:
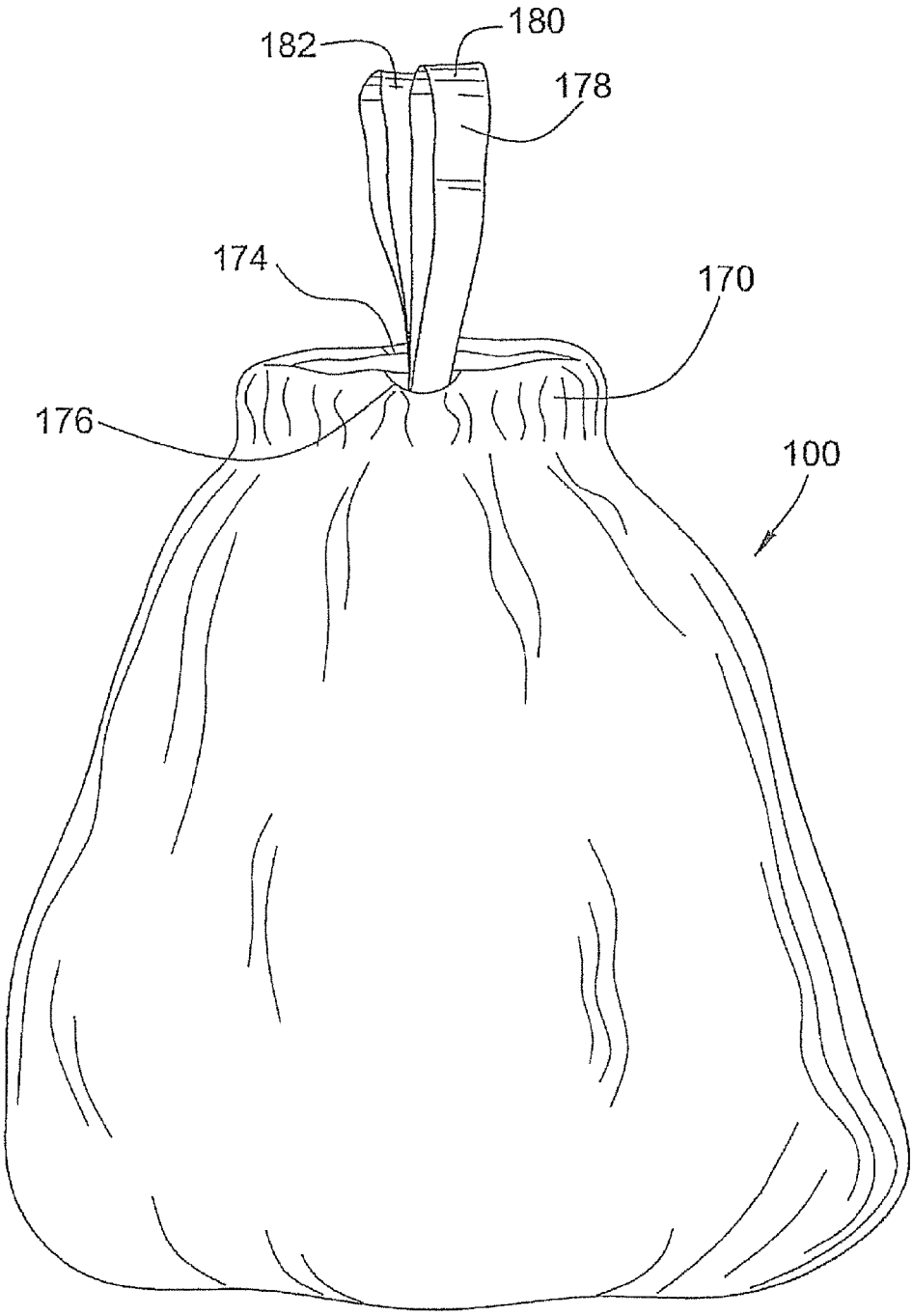
FIG. 8 is a perspective view of the bag of FIG. 4 wherein the drawstrings have been drawn to close the bag.
Figure 9:
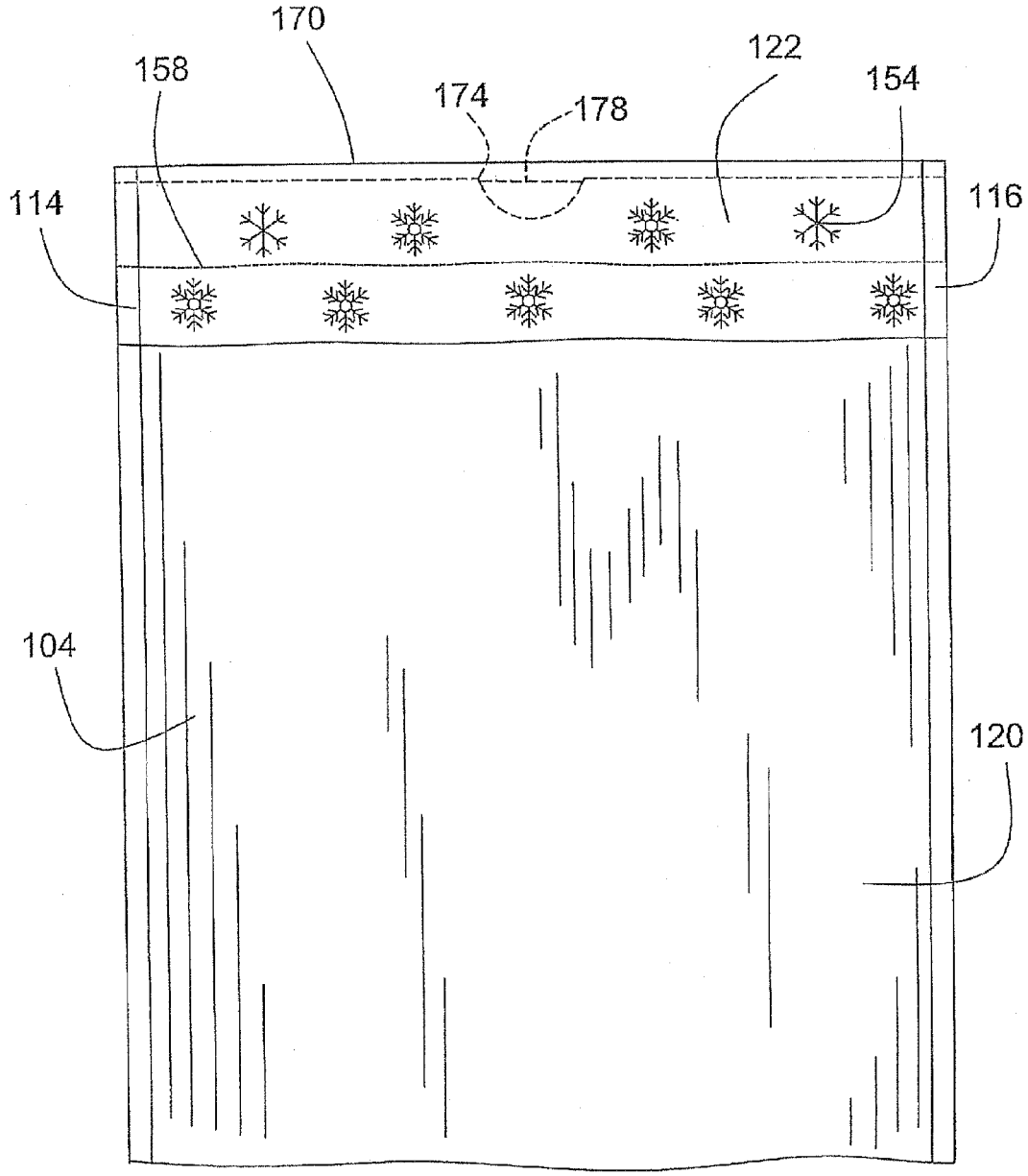
FIG. 9 is a cross sectional view taken along line 9-9 of the bag of FIG. 4.

Referring to FIG. 5 the bag may include a hem 170 and the hem may define the rim 108. The hem 170 may further define a passageway 172, which is at least partially enclosed, as show in FIG. 11. Referring to FIG. 5, the hem 170 may include a first opening 174 and a second opening 176. The bag 100 may comprise a drawstring 178, which is disposed within the passageway 172. The drawstring 178 may be accessible via the first and second openings 174, 176 in the hem 170. Referring to FIG. 8, the drawstring 178 allows a user to at least partially close the bag 100 by pulling on the two loops 180, 182 of the drawstring 178.

Figure 10:
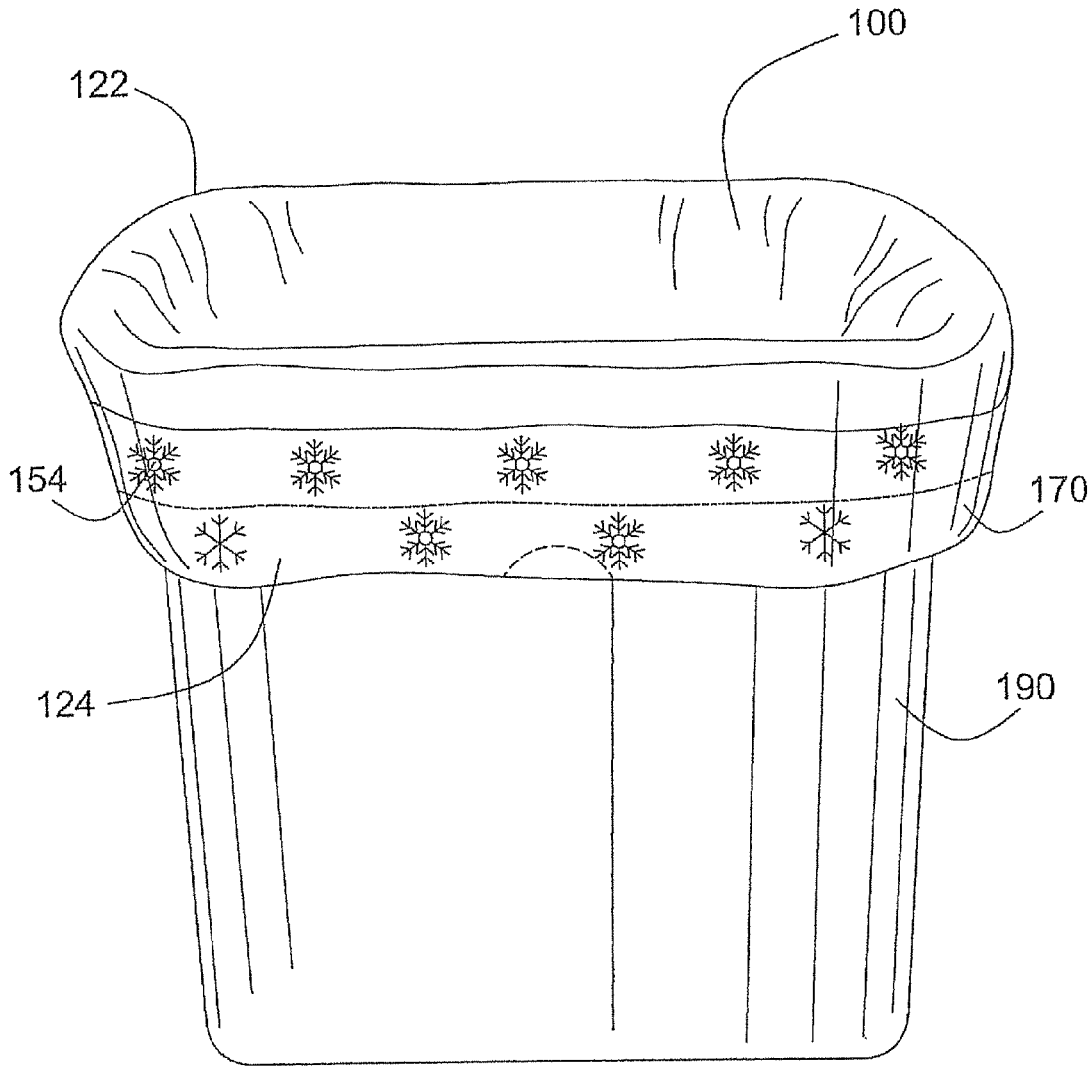
FIG. 10 is a perspective view of the bag of FIG. 4 inserted into a trash receptacle.

Referring to FIG. 10, the bag 100 may be arranged inside a trash receptacle 190. As the upper portions of the bag 100 are folded over the rim of the trash receptacle 190, the strips 122, 124 may become exposed on the outside of the receptacle 190. Accordingly, the printed design 154 will be visible outside the receptacle 190, possibly even when a lid is placed over the receptacle.

Figure 11:
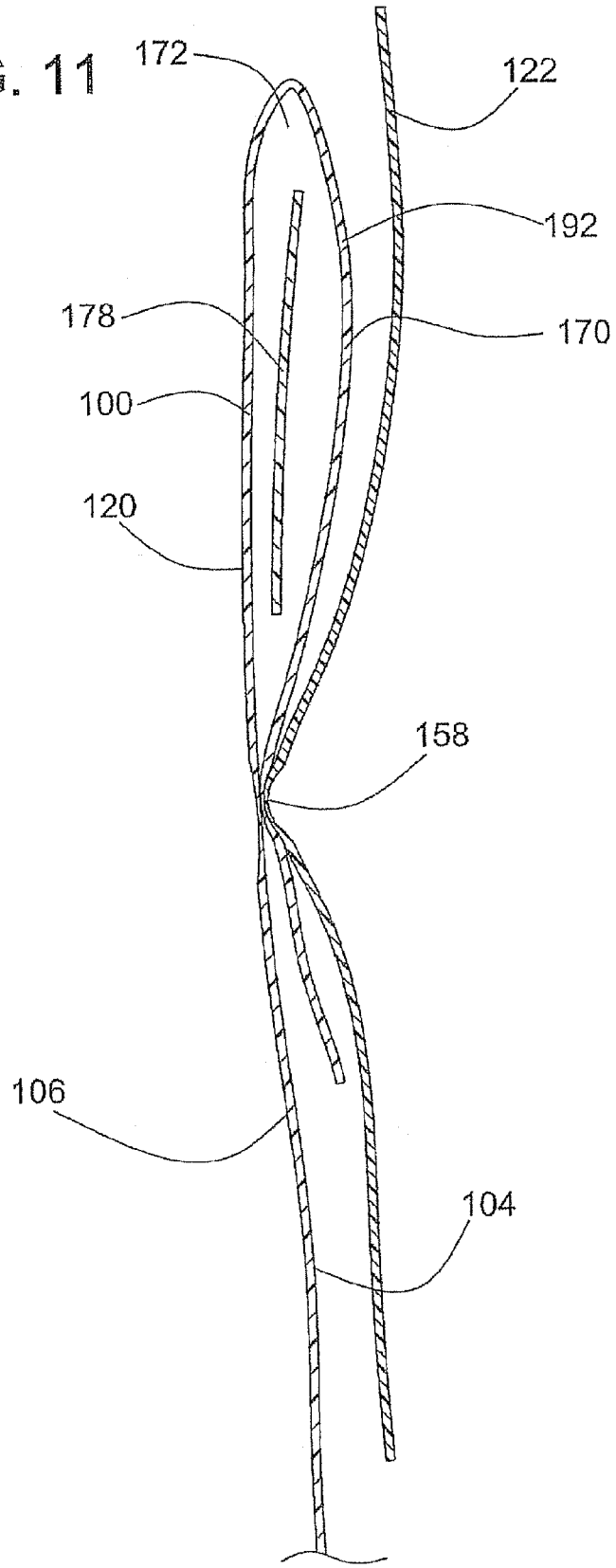
FIG. 11 is another cross sectional view taken along line 11-11 of the bag of FIG. 4.

The back wall of bag may be a mirror image of the front wall of the bag. Accordingly, only the back wall of the bag will be described in detail. Referring to FIG. 11, the hem 170 may be formed by folding an upper portion 192 of the back wall 120 of the bag 100 onto the inside surface 104 of the bag 100, and sealing it thereto at the first seal 158. The drawstring 178 is disposed within the passageway 172 thus created. The strip 122 may also be joined to the inside surface 102 of the bag at the first seal 158.

The bag and bag components may be made of plastic. Certain plastics do not have optimum characteristics for receiving ink or other methods of permanent marking when print is applied. Accordingly, printed designs may not be applied correctly or they may tend to run or smear after being applied. In order to better prepare the strips of the present invention for print, the strips may be corona treated. Corona treatment is a surface treatment that is applied to polymer films in order to improve compatibility with printing inks. However, once a plastic surface has been corona treated, the plastic surface often has diminished qualities for being sealed to another corona treated surface such, as for example, in the left and right side seams of the bag. When two corona treated surfaces are sealed together in the seams of a bag, the seams of the bag may be weakened. Because bag failures may be initiated at weakened points of the seam, it is desirable to avoid sealing two corona treated surfaces together. This is especially true at the ends of bag seams, where seam failure is of particular risk due to the increased stresses experienced by seams at the rim of a bag.

Figure 14:
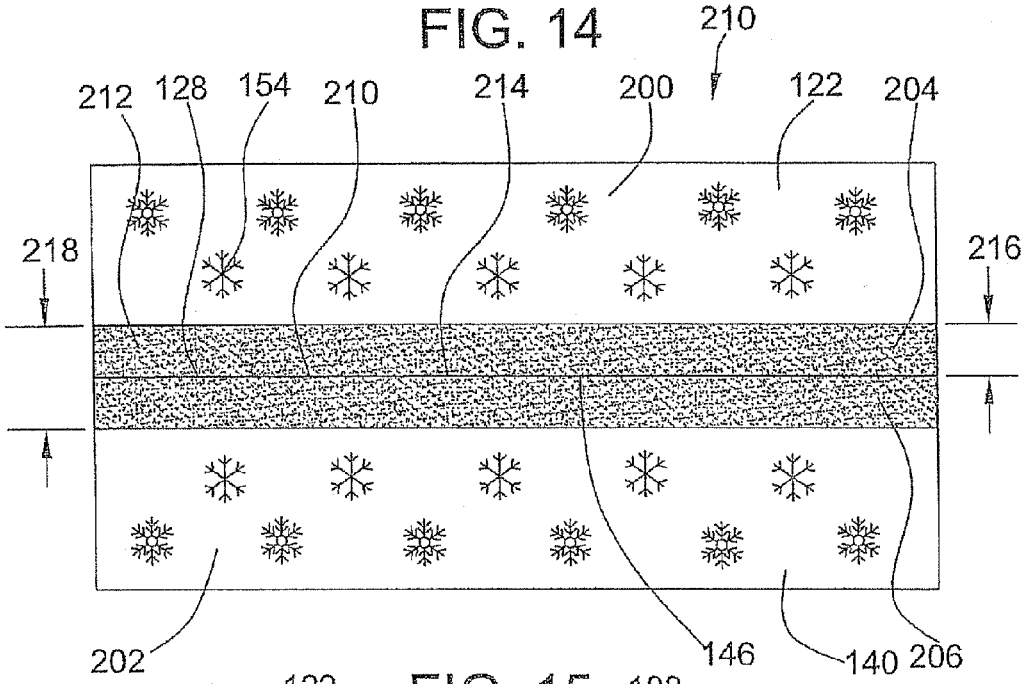
FIG. 14 is a partial view of the preassembly sheet of material for another embodiment.

Referring to FIG. 14, before the strips 122, 140 receive the print, the lower portions 200, 202 of the strips 122, 140 may be corona treated. On both strips 122, 140, there are maintained areas, such as for example, bands 204, 206, running along the top edges 128, 146 of the strips 122, 140 that are not corona treated. Accordingly, the printed design 154 may be applied to the lower portions 200, 202 of the strips 122, 140. The band 204 which is not corona treated may have a width 216 in a first range of 0.125 to 12 inches (0.3175 to 30 cm), a second range of 0.25 to 6 inches (0.635 to 15 cm), and a third range of 0.25 to 1 inches (0.635 to 2.54 cm). In one embodiment, the band 204 may have a width of 0.5 inches (1.27 cm). In order to make the manufacturing process more efficient, both strips 122, 240 may be produced from a single sheet 210 of material wherein they share an untreated area 212, which may have a width 218. In one embodiment, the width 218 may be 1 inch (2.54 cm). The strips 122, 140 are then separated in this untreated area along a cut 214. The cut 214 may define the top edges 128, 146 of the strips 122, 140. In other embodiments, multiple strips may be manufactured from a single sheet of material.

Figure 15:
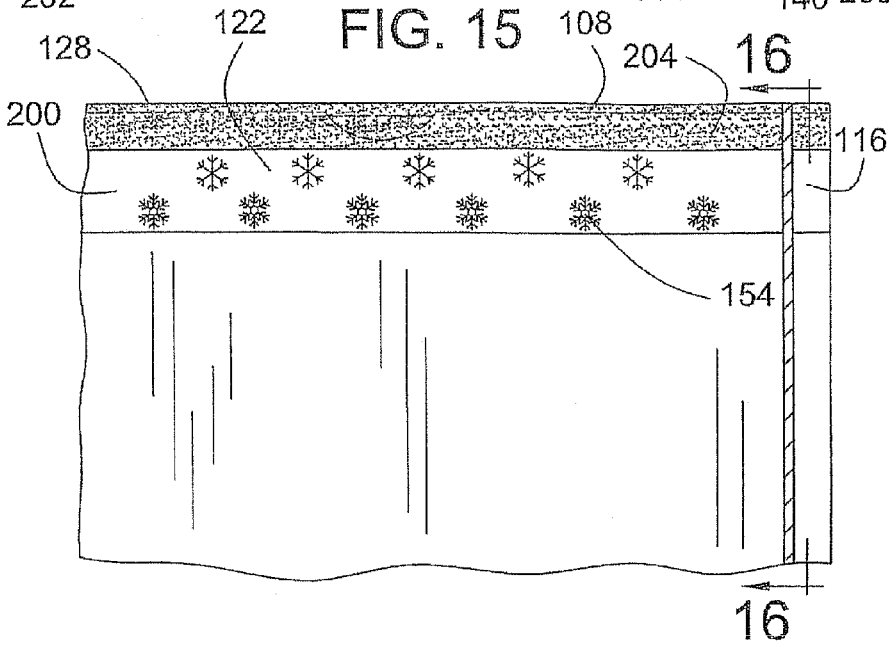
FIG. 15 is a partial cross sectional view of a bag assembled from the sheet of FIG. 14.
Figure 16:
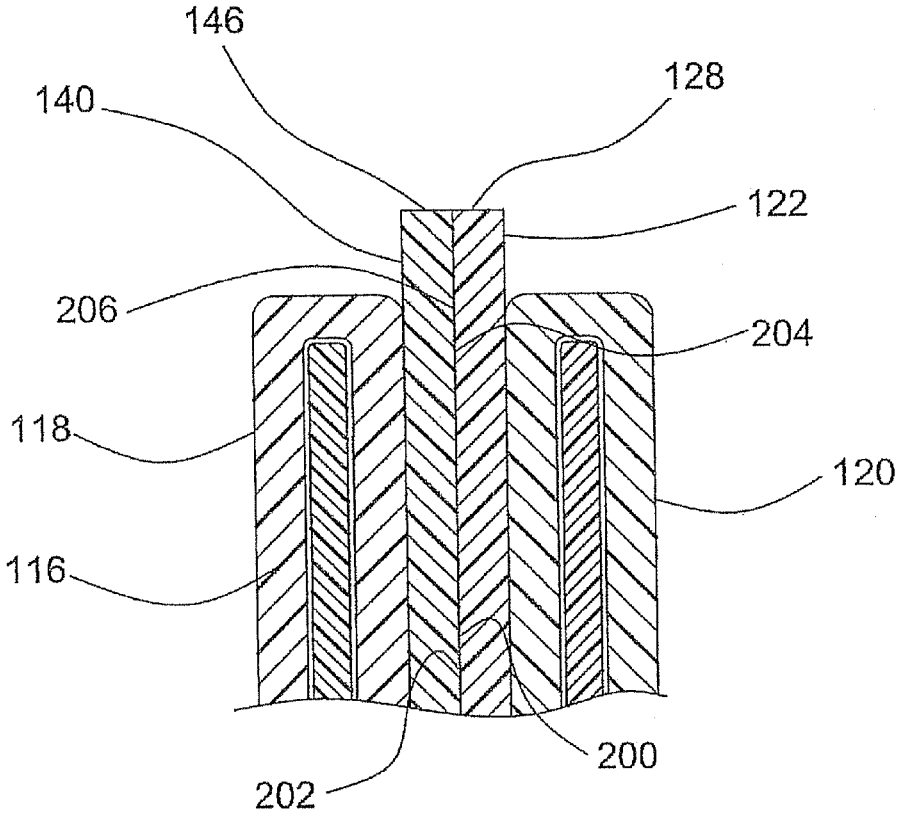
FIG. 16 is another partial cross sectional view along line 16-16 of FIG. 15.

Referring to FIG. 5, the inside surface 124 of the first strip 122 and the inside surface 142 of the second strip 140 will be joined together at the left seam 114 and the right seam 116. Referring to FIG. 15, it can be seen that the non-corona treated band 204 of the first strip 122 will be located at the top of the right side seal 116. The front wall 118, including the second strip 140, may be joined in the right side seam 116 to the back wall 120 and the first strip 122 in a mirror image, as seen in FIG. 16. This construction ensures that the untreated bands 204, 206 of the first and second strips 122, 140 are sealed together at the top of the right side seam 116. Because the left side seam may be similarly constructed, the bag will have no corona treated surfaces joined to other corona treated surfaces at the rim 108 of the bag in either seam. The bag 100 will therefore be more resistant to failures initiated at the seams. In other embodiments, only one strip of the bag may have an untreated band proximate the top edge of the strip.

Figure 17:
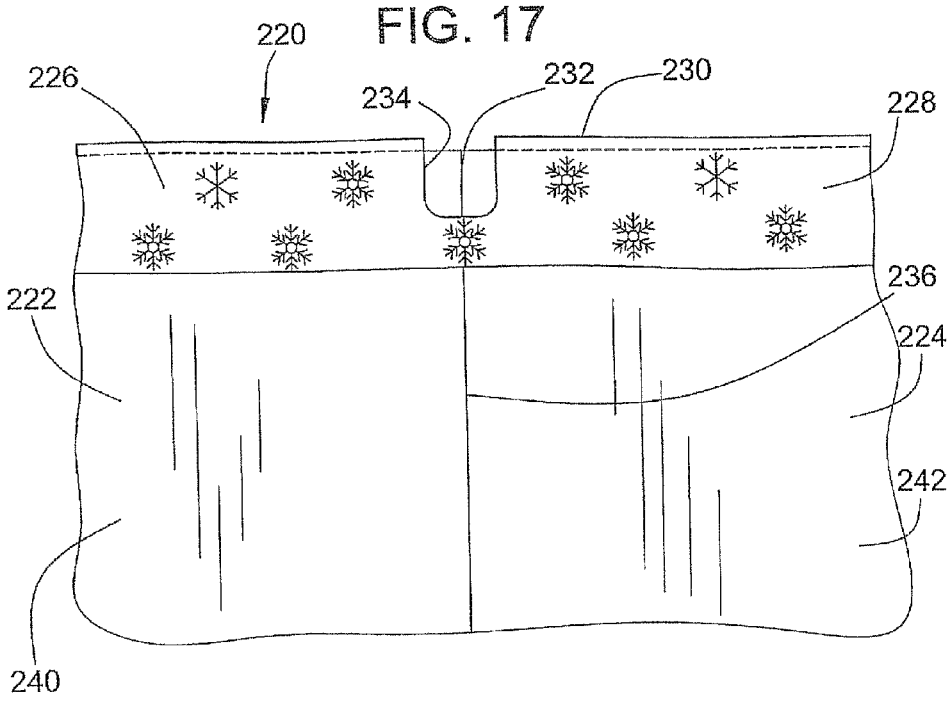
FIG. 17 is a partial view of a preassembly sheet of material for the bag of FIG. 4.

Referring to FIG. 17, there is shown another embodiment. In order to mitigate the effects of joining corona treated surfaces, the bags may be produced such that the strips are notched at their first ends and second ends. The front wall and the back wall of bags may be produced from large sheets. A representative back wall sheet 220 for producing multiple bags 222, 224 is show in FIG. 17. The sheet 220 may be produced such that at predetermined intervals corresponding to the lengths of the strips 226, 228, the strips 226, 228 will be notched at the top edge 230. The front wall pieces and second strips may be produced in a similar process.

Figure 18:
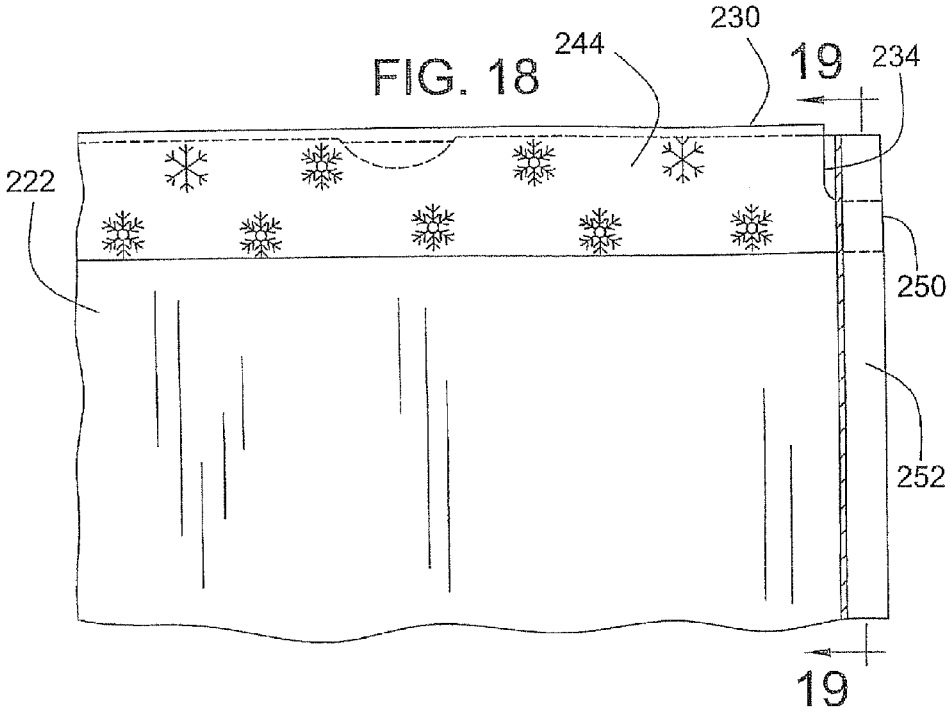
FIG. 18 is a partial cross sectional view of a bag assembled from the sheet of FIG. 17.
Figure 19:
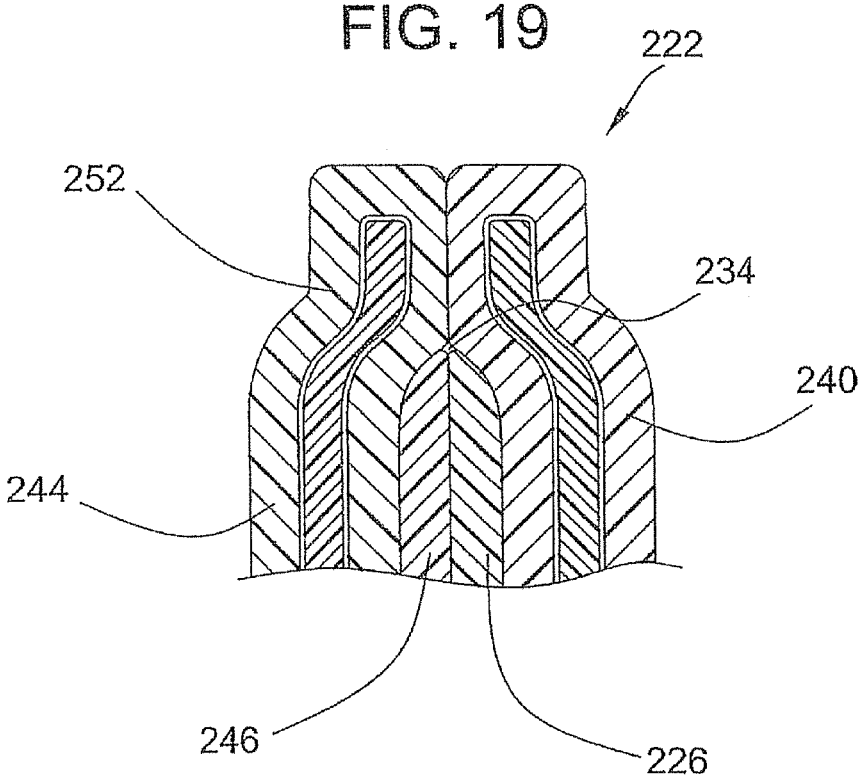
FIG. 19 is another partial cross sectional view along line 19-19 of FIG. 18.

Referring to FIG. 18, the second end 250 of the first strip 244, which is part of the seam 252, will include the notch 234 such that the top edge 230 of the strip 244 does not enter the seam 252. The front wall sheet of the bag and the second strip may be joined to the back wall sheet of the bag and the first strip in a mirror image at the right side seam 252. The left side seam may be constructed in the same manner. The sheet 220 may then be cut at location 232 of a notch 234 along a cut 236 to create the back wall pieces 240, 242, including the first strips 226, 228, for the bags 222, 224. The front wall pieces and second strips may be cut at the same time as the back wall pieces and first strips in order to create separate bags. Referring to FIG. 19, in seam 252 of the now independent bag 222, the front wall 244 and second strip 246 are joined to the back wall 240 and the first strip 226. However, because of the notch 234, the strips 226, 246 will be absent from the tops of the side seams at the rim. The bags will have no corona treated surfaces joined to other corona treated surfaces at the rim of the bag in either seam. The bag will therefore be more resistant to failures initiated at the seams. The notches may be used with any of the embodiments noted herein, as appropriate.

Figure 20:
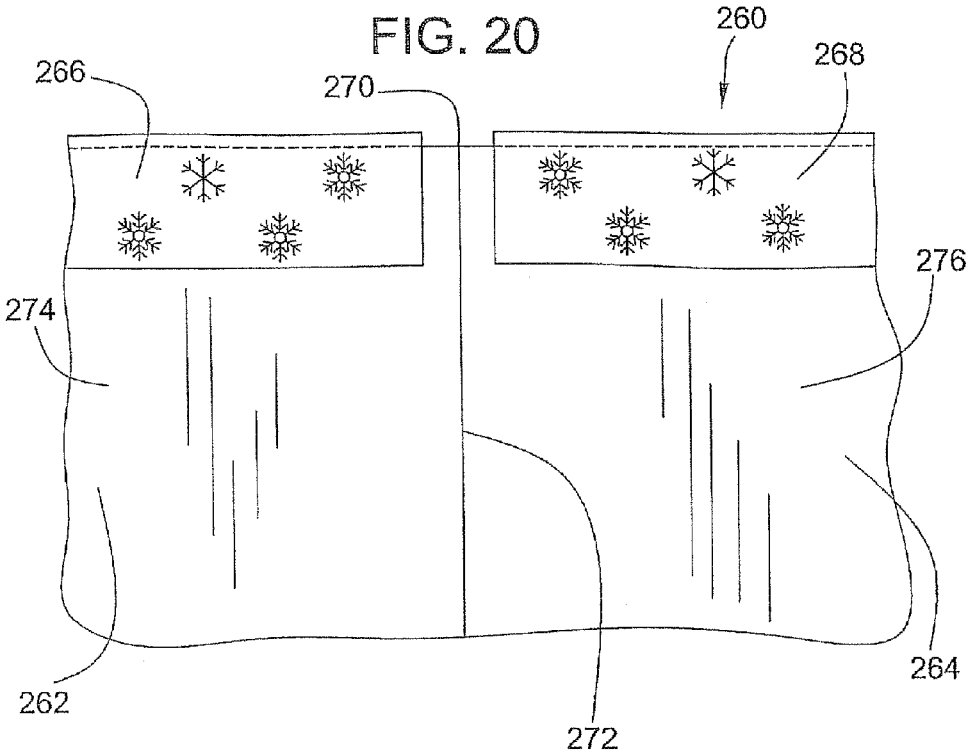
FIG. 20 is a partial view of a preassembly sheet of material for another embodiment.

Referring to FIG. 20, there is shown another embodiment. In order to mitigate the effects of joining corona treated surfaces, the bags may be produced such that the lengths of the strips between their first and second ends are shorter than the distance between the right and the left seams. The front wall and the back wall of bags may be produced from large sheets. A representative back wall sheet 260 for producing multiple bags 262, 264 is show in FIG. 20. The sheet 260 may be produced such that at predetermined intervals corresponding to the width of the bag, the strips 266, 268 will be separated.

Figure 21:
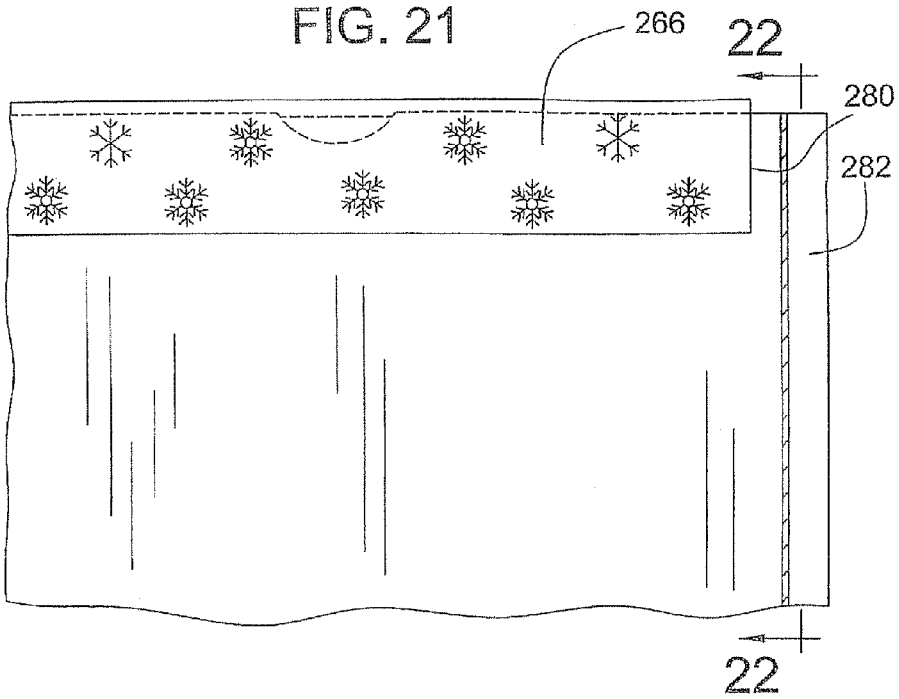
FIG. 21 is a partial cross sectional view of a bag assembled from the sheet of FIG. 20.
Figure 22:
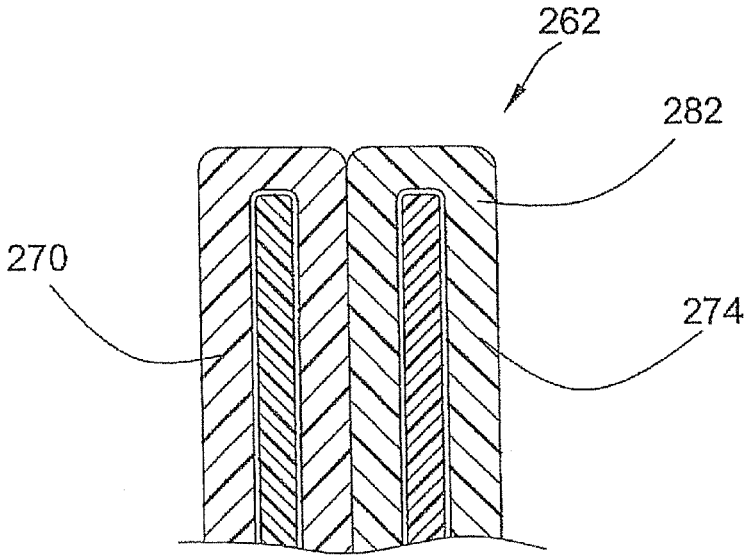
FIG. 22 is another partial cross sectional view along line 22-22 of FIG. 21.

Referring to FIG. 21, the second end 280 of the strip 266 will stop short of the right seam 282. Likewise, the first end of the seam will stop short of the left seam. The front wall of the bag and the second strip may be produced as a mirror image and then the front wall and the back wall of the bag may be joined at the right and left seams. The sheet may then be cut at location 270 of these separations at cut 272 to create the back walls 274, 276 for the bags 262, 264. The front wall pieces and second strips may be cut at the same time as the back wall pieces and first strips in order to create separate bags. Referring to FIG. 22, in the now independent bag 262, the front wall 270 and back wall 274 are joined at the right seam 282, but the strips are not. Because the left seam is similarly constructed, the strips will be absent from the side seams. The bag will have no corona treated surfaces joined to other corona treated surfaces at the rims of the bags in either seam. The bag will therefore be more resistant to failures initiated at the seams. This feature may be used with any of the embodiments noted herein, as appropriate.

Figure 23:
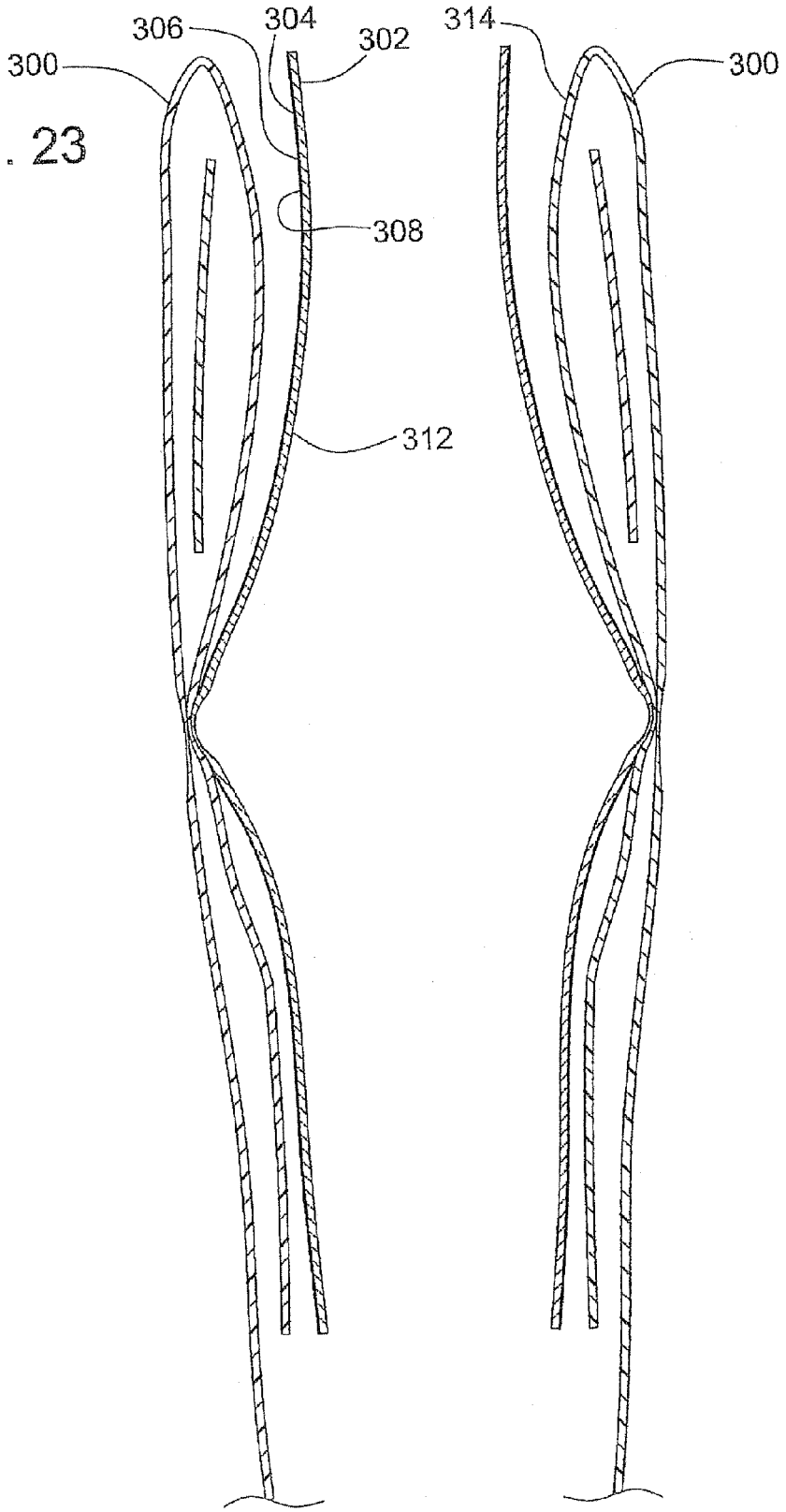
FIG. 23 is a cross sectional view of another embodiment.

Referring to FIG. 23, there is shown another embodiment. The bag 300 may include a strip 302, wherein the strip 302 is transparent. The strip 302 has been corona treated on its outside surface 304 and, subsequently, the printed design 306 has been applied to the outside surface 304. A non-transparent treatment 308 may be applied over the printed design 306. The treatment 308 may be, for example, a solid color. Because the strip 302 is transparent, the printed design 306 is still clearly visible while looking at the inside surface 312 of the strip 302. The other half 314 of the bag 300 may be constructed as a mirror image. Accordingly, when the bag is assembled there will be no corona treated surfaces joined to another corona treated surface in the left or right seals. The bag will therefore be more resistant to failures initiated at the seams. This feature may be used with any of the embodiments noted herein, as appropriate.

Figure 24:
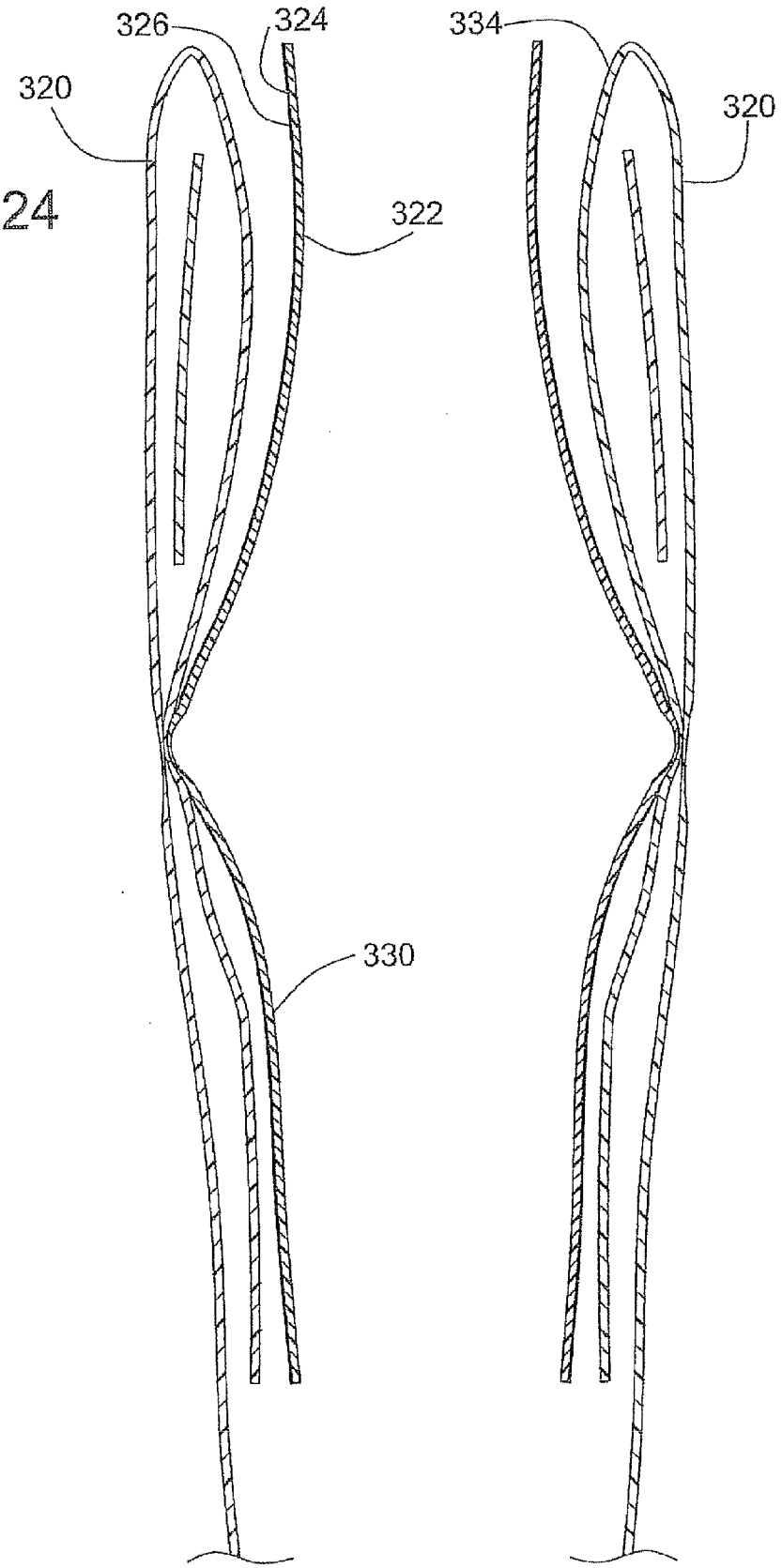
FIG. 24 is a cross sectional view of another embodiment.

Referring to FIG. 24, there is shown another embodiment of the present invention. The bag 320 may include a strip 322, wherein the strip 322 is translucent. The strip 322 has been corona treated on its outside surface 324 and, subsequently, the printed design 326 has been applied to the outside surface 324. Because the strip 322 is translucent, the printed design 326 is at least partially visible while looking at the inside surface 330 of the strip 322. The other half 334 of the bag 320 may be constructed as a mirror image. Accordingly, when the bag is assembled there will be no corona treated surfaces joined to another corona treated surface in the left or right seals. The bag will therefore be more resistant to failures initiated at the seams. This feature may be used with any embodiments noted herein, as appropriate.

Figure 25:
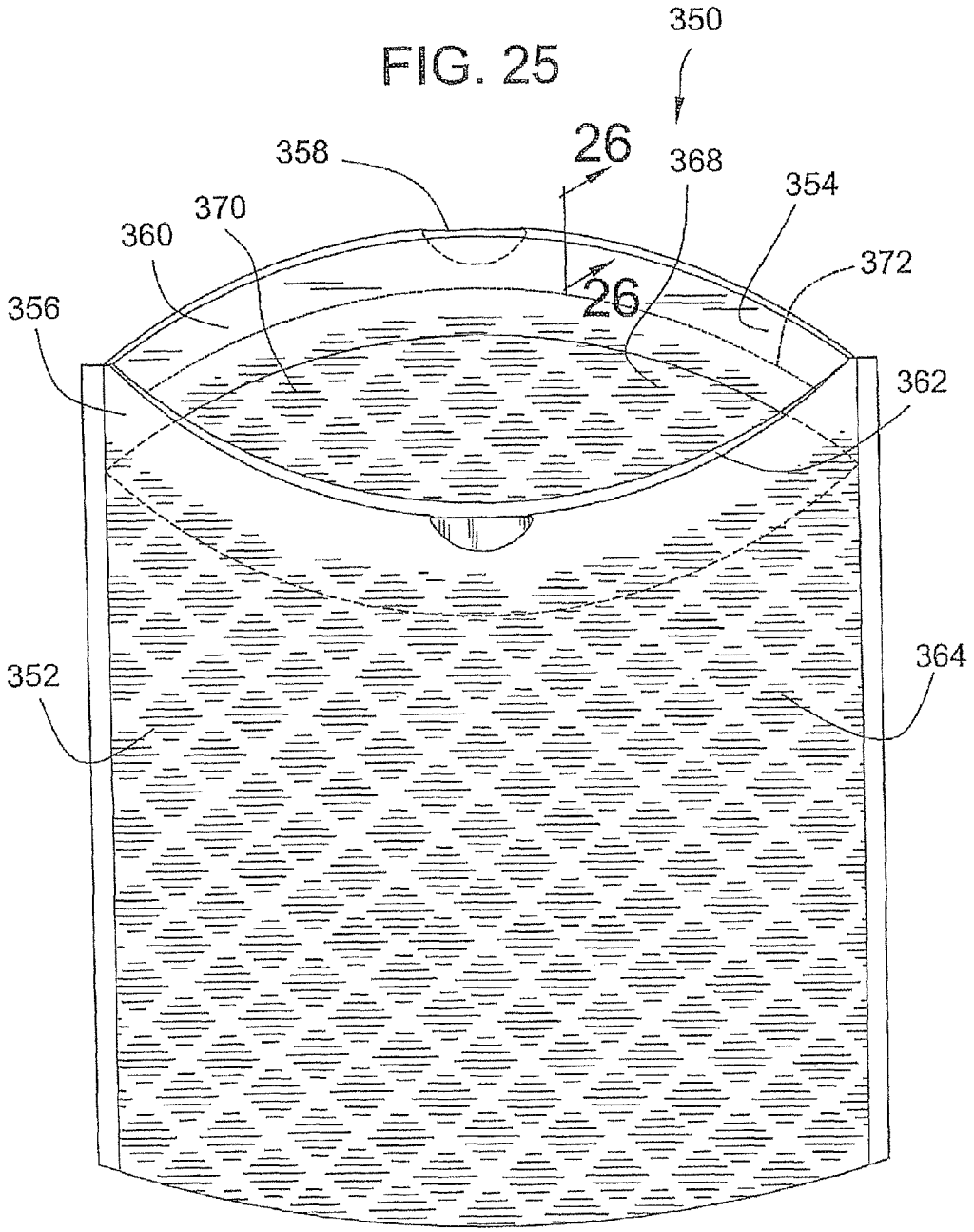
FIG. 25 is a perspective view of another embodiment.

Referring to FIG. 25, there is shown another embodiment. The bag 350 may include a front wall 352, a back wall 354, a hem 356, a drawstring 358, a first strip 360, and a second strip 362. The bag body 364 has been subjected to an embossing process wherein the majority of the bag now includes an embossing pattern 368. The embossing pattern 368 may be an arrangement of diamond shaped regions 370 where the bag body 364 has been plastically deformed. The first strip 360 may be joined to the back wall 354 of the bag 350 along a first seal 372. The second strip may be joined to the bag along a second seal.

The embossing pattern 368 may better permit the bag to stretch or yield to accommodate cumbersome or bulky objects without puncturing, thereby further preventing leaks. The embossing pattern may be a product or process consistent with those described in U.S. Pat. No. 6,139,185; U.S. Publication No. 2004/0134923; U.S. Pat. No. 6,394,651; U.S. Pat. No. 6,394,652; U.S. Pat. No. 6,150,647; U.S. Pat. No. 6,513,975; or U.S. Pat. No. 6,695,476; which are hereby incorporated herein by reference in their entirety.

Figure 26:
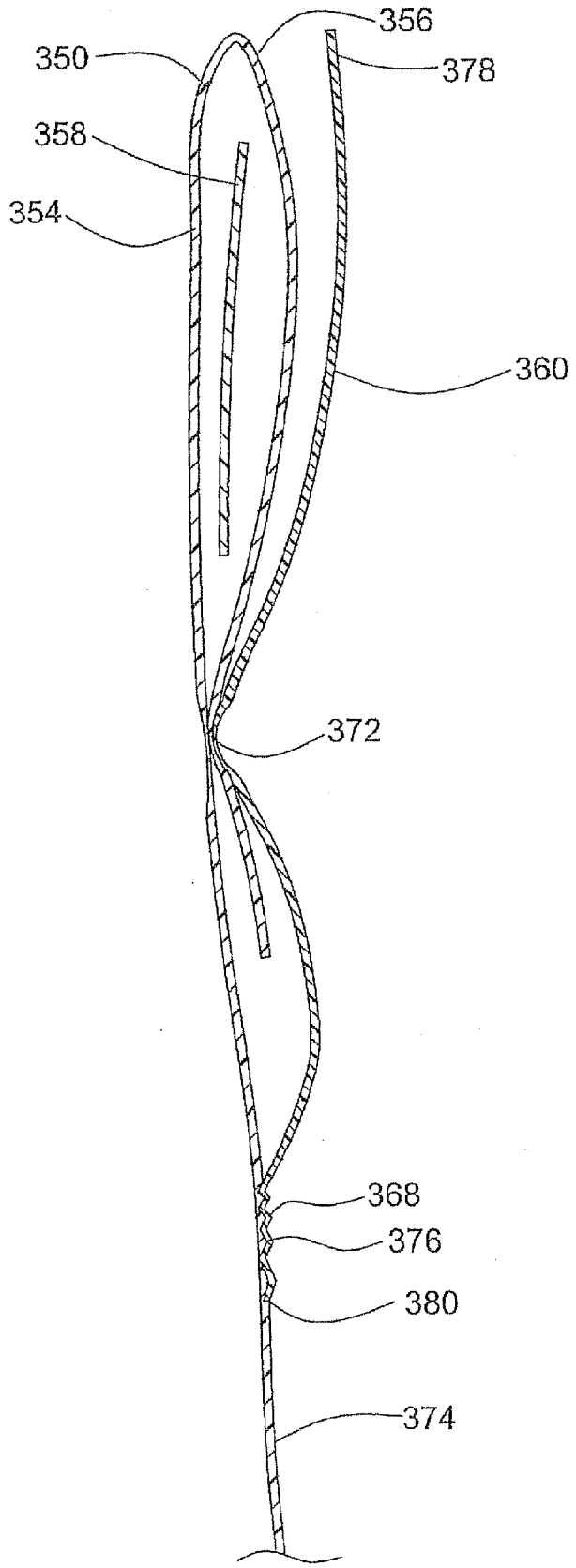
FIG. 26 is a cross sectional view taken along line 26-26 of the bag of FIG. 25.

The front wall 352 of the bag may be identical to the back wall 354 of the bag 350 so only the back wall 354 of the bag 350 will be described detail. Referring to FIG. 26, the hem 356, the strip 360, and the back wall 354 of the bag may all be joined at the first seal 372. The strip 360 may be joined to the inside surface 374 of the back wall 354 of the bag 350 in a second location 376 by the embossing process. The top edge 378 of the strip 360 may remain free but the bottom edge 380 may be joined to bag 350 by nature of the fact that the strip 360 is subjected to the embossing process while disposed against the back wall 354 of the bag 350. The strip 360 may be loosely joined to the bag 350 by the embossing process such that the strip 360 may be separated from the bag 350. The embossing process may be used with any embodiments noted herein, as appropriate.

Figure 27:
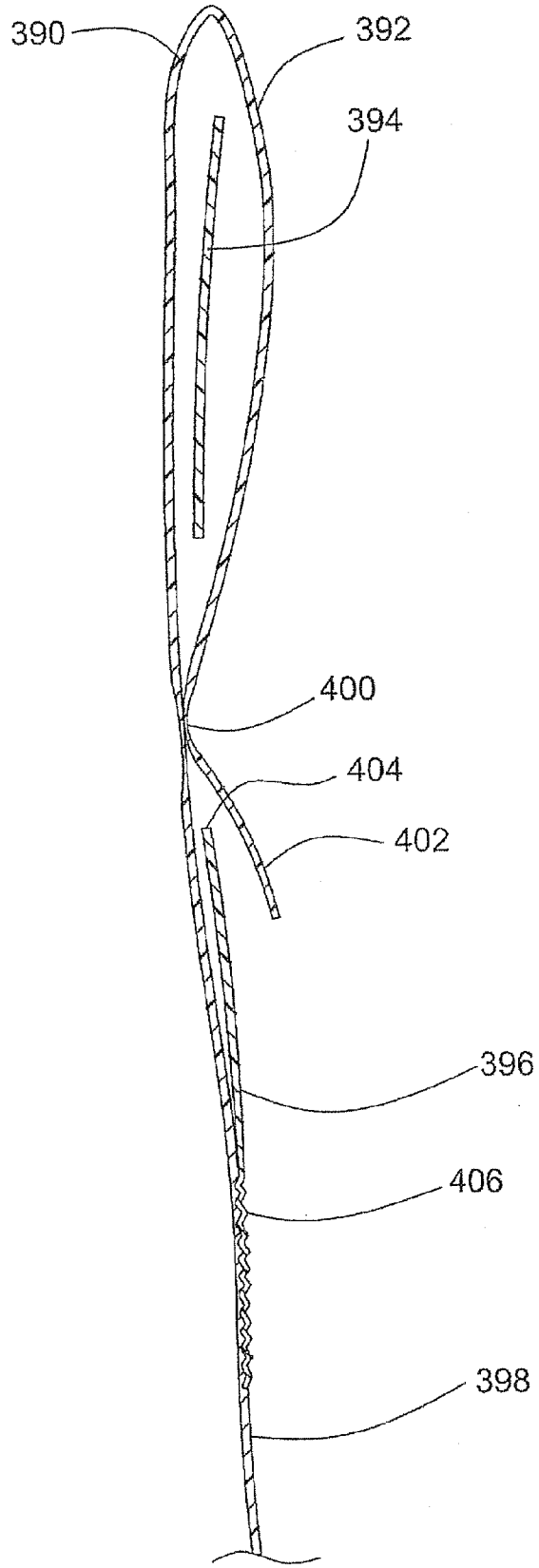
FIG. 27 is a cross sectional view of another embodiment.

Referring to FIG. 27 there is shown another embodiment. The bag 390 may include a hem 392, a drawstring 394, and a strip 396. The bag 390 has been subjected to an embossing process. The hem 392 may be joined to the inside surface 398 of the bag 390 of the bag along a first seal 400. The hem 392 may include an overhang 402, which extends down from the first seal 400. The top edge 404 of strip may be tucked below the hem overhang 402 in order to loosely secure the strip 396 to the bag 390. The strip 396 may also be joined to the inside surface 398 of the bag 390 by the embossing process at a location 406. The strip 396 may be loosely joined to the bag 390 by the embossing process such that the strip 396 may be separated from the bag 390. Accordingly, the entire strip 396 may be removed from the bag 390 by a user without excessive effort. However, the strip 396 may remain held in place against the bag 390 during normal use. This feature may be used in any of the embodiments noted herein, as appropriate.

Figure 28:
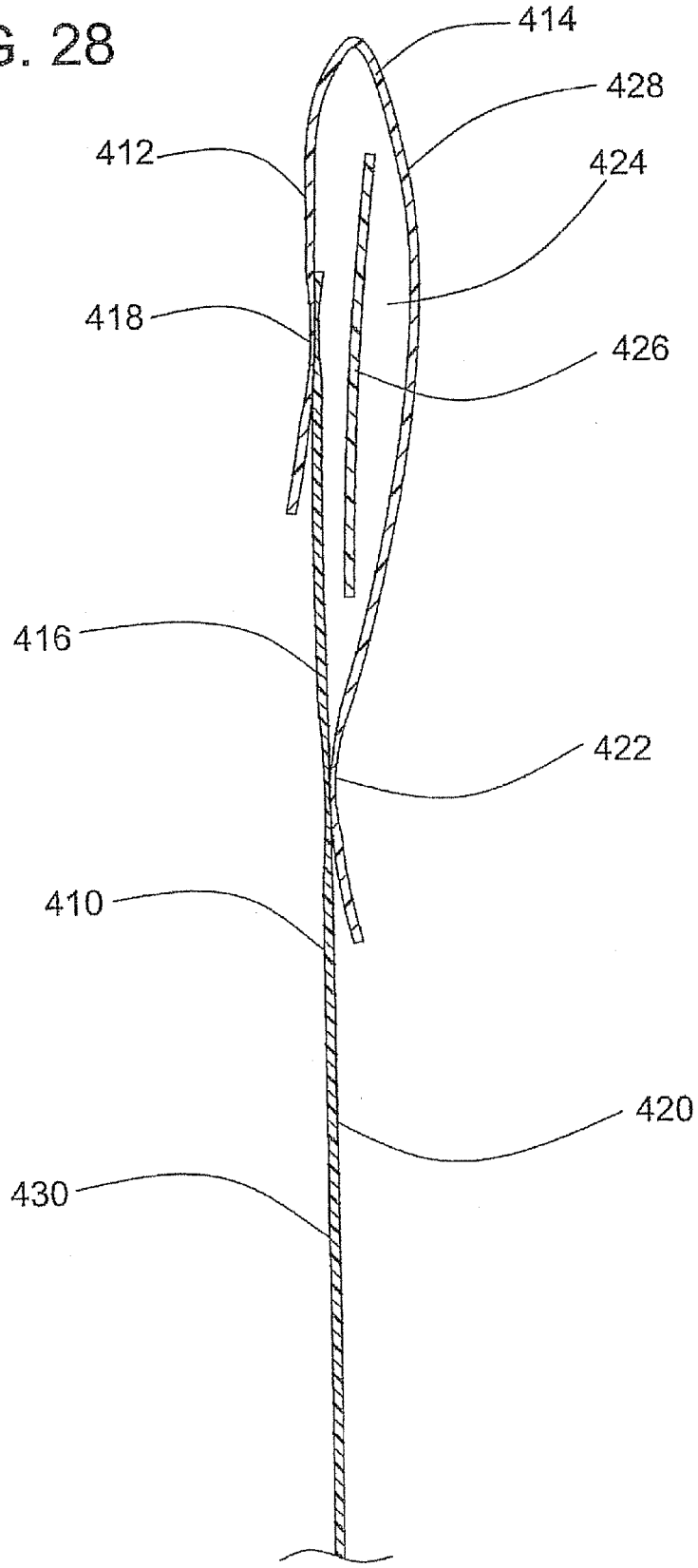
FIG. 28 is a cross sectional view of another embodiment.

Referring to FIG. 28, there is shown another embodiment. FIG. 28 shows a cross sectional view of the back wall 410 of the bag 412 wherein the front wall may be a mirror image. The bag 412 may include a hem 414 wherein the hem 414 is a separate piece of material. The hem 414 may be attached to the outside surface 416 of the bag 412 along a first seal 418 and attached to the inside surface 420 along a second seal 422, which may be lower than the first seal 418. The hem 414 defines a passageway 424. A drawstring 426 may be disposed in the passageway 424. The inside surface 428 of the hem 414 may include a printed design. The hem 414 may be of thicker material than the bag body 430. The bag 412 is more resistant to failures when the hem 414 is made of relatively thicker material, as the hem 414 is subject to increased stresses due to user manipulation of the hem 414 and drawstring 426. In other embodiments, the hem may have different properties than other portions of the bag such as, printed design, color, odor neutralizing agent, liquid absorbing agent, antimicrobial agent, fragrance releasing agent, thickness, strength, and/or material composition, as appropriate.

Figure 29:
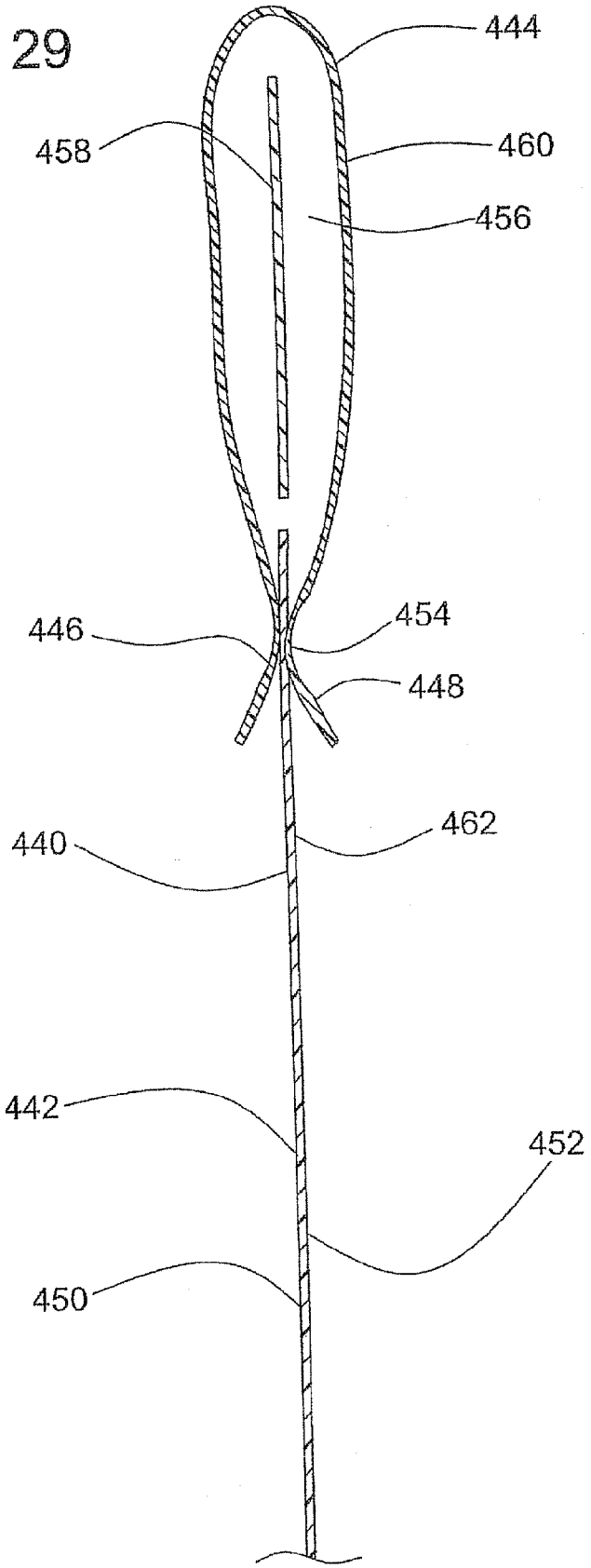
FIG. 29 is a cross sectional view of another embodiment.

Referring to FIG. 29, there is shown another embodiment. FIG. 29 shows a cross sectional view of the back wall 440 of the bag 442 wherein the front wall may be a mirror image. The bag 442 may include a hem 444 wherein the hem 444 is a separate piece of material. Opposing ends 446, 448 of the hem 444 may be attached to the outside 450 and inside 452 of the bag 442 at a first seal 454. The hem 444 defines a passageway 456. A drawstring 458 may be disposed in the passageway 456. The inside surface 460 of the hem 444 may include a printed design. The hem 444 may be of thicker material than the bag body 462. In other embodiments, the hem may have different properties than other portions of the bag such as, printed design, color, odor neutralizing agent, liquid absorbing agent, antimicrobial agent, fragrance releasing agent, thickness, strength, and/or material composition, as appropriate.

Figure 30:
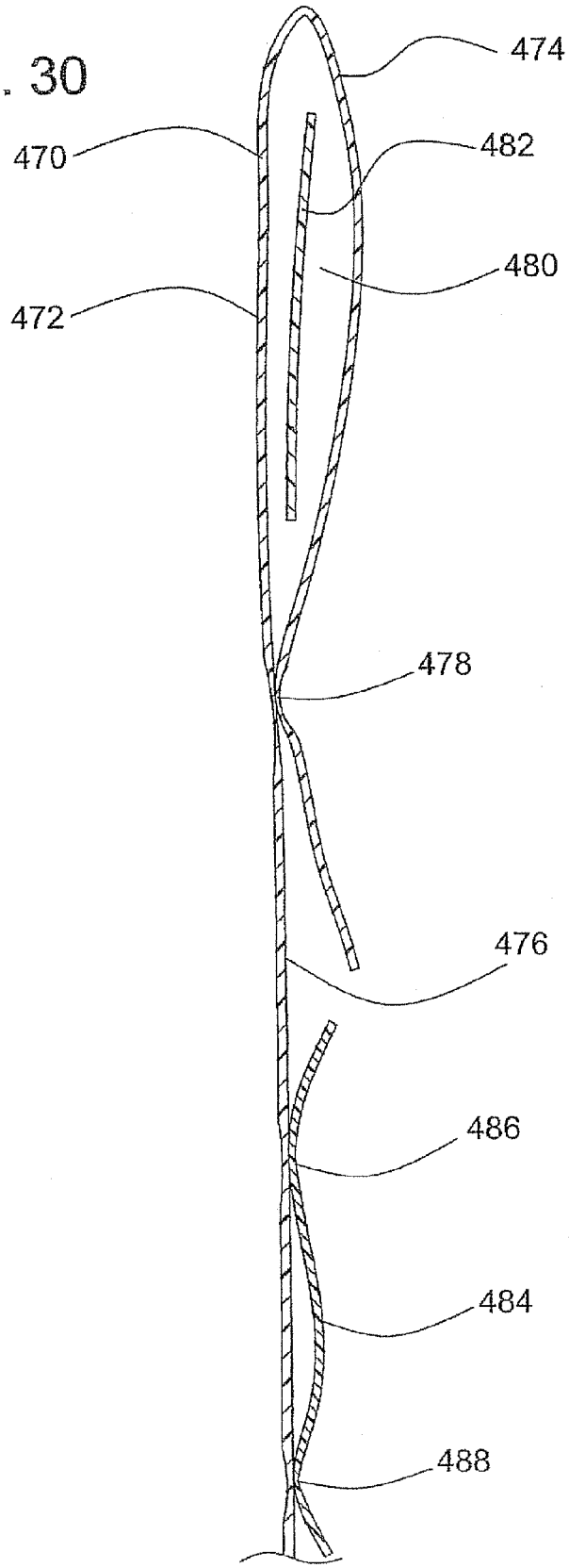
FIG. 30 is a cross sectional view of another embodiment.

Referring to FIG. 30, there is shown another embodiment. FIG. 30 shows a cross sectional view of the back wall 470 of the bag 472 wherein the front wall may be a mirror image. The bag 472 may include a hem 474 wherein the hem 474 is attached to the inside surface 476 of the bag 472 along a first seal 478. The hem 474 defines a passageway 480. A drawstring 482 may be disposed in the passageway 480. The bag 472 may include a strip 484 of material disposed on the inside surface 476 of the bag 472 below the hem 474. The strip 484 may be joined to the bag 472 at a second seal 486 and at a third seal 488. The strip 484 may include a printed design. In other embodiments, the strip may have different properties than other portions of the bag such as, printed design, color, odor neutralizing agent, liquid absorbing agent, antimicrobial agent, fragrance releasing agent, thickness, strength, and/or material composition, as appropriate.

Figure 31:
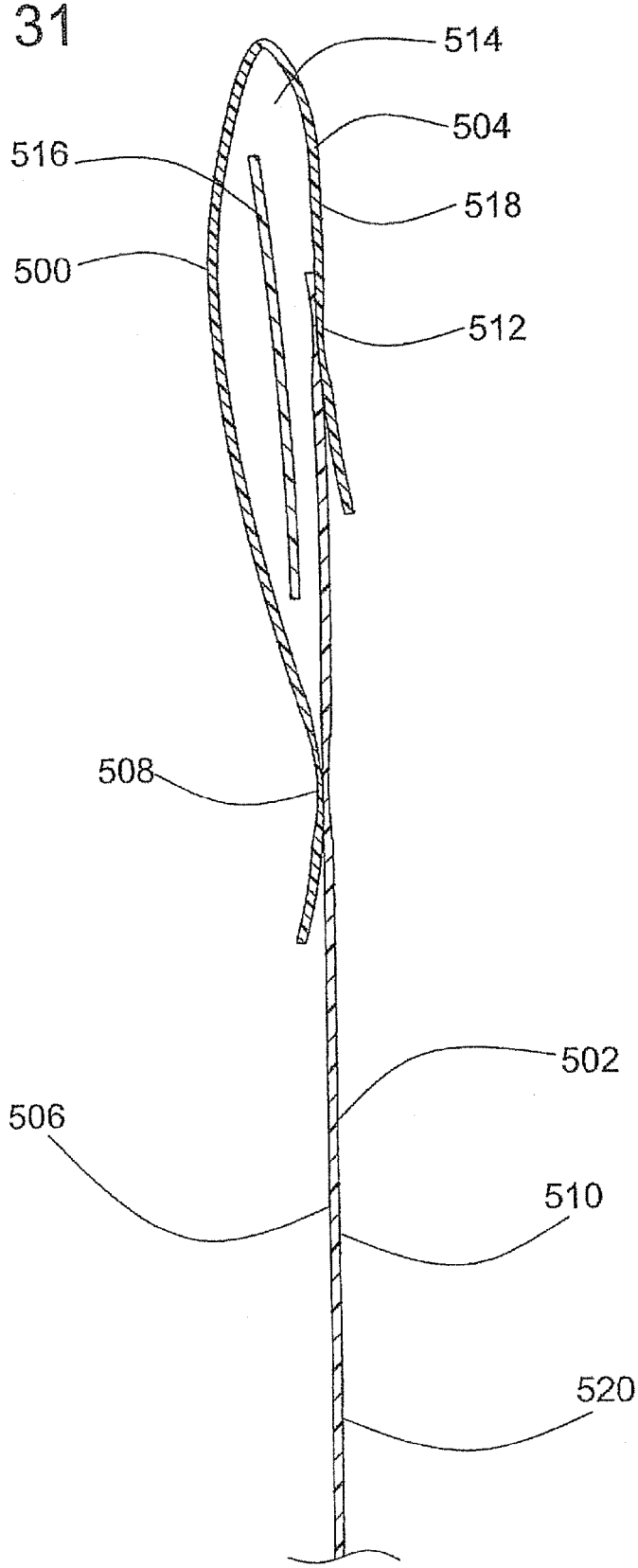
FIG. 31 is a cross sectional view of another embodiment.

Referring to FIG. 31, there is shown another embodiment. FIG. 31 shows a cross sectional view of the back wall 500 of the bag 502 wherein the front wall may be a mirror image. The bag 502 may include a hem 504 wherein the hem 504 is a separate piece of material. The hem 504 may be attached to the outside surface 506 of the bag 502 along a first seal 508 and attached to the inside surface 510 along a second seal 512, which may be higher than the first seal 508. The hem 504 defines a passageway 514. A drawstring 516 may be disposed in the passageway 514. The inside surface 518 of the hem 504 may include a printed design. The hem may be of thicker material than the bag body 520. In other embodiments, the hem may have different properties than other portions of the bag such as, printed design, color, odor neutralizing agent, liquid absorbing agent, antimicrobial agent, fragrance releasing agent, thickness, strength, and/or material composition, as appropriate.

Figure 32:
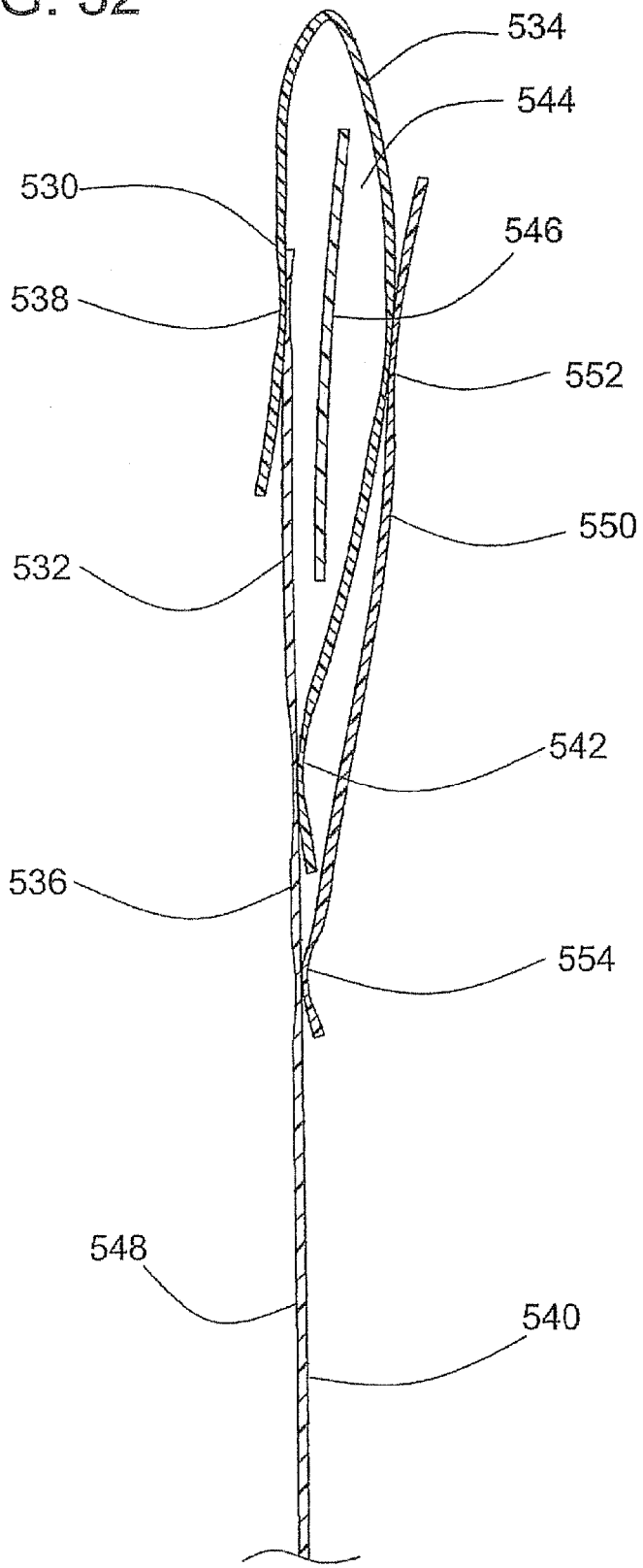
FIG. 32 is a cross sectional view of another embodiment.

Referring to FIG. 32, there is shown another embodiment. FIG. 32 shows a cross sectional view of the back wall 530 of the bag 532 wherein the front wall may be a mirror image. The bag 532 may include a hem 534 wherein the hem 534 is a separate piece of material. The hem 534 may be attached to the outside surface 536 of the bag 532 along a first seal 538 and attached to the inside surface 540 along a second seal 542, which may be lower than the first seal 538. The hem 534 defines a passageway 544. A drawstring 546 may be disposed in the passageway 544. The hem 534 may be of thicker material than the bag body 548. The bag 532 may include a strip 550 joined to the inside surface 540 along a third seal 552, located on the hem 534, and a second seal 554. The strip 550 may include a printed design. In other embodiments, the hem and/or strip may have different properties than other portions of the bag such as, printed design, color, odor neutralizing agent, liquid absorbing agent, antimicrobial agent, fragrance releasing agent, thickness, strength, and/or material composition, as appropriate.

Figure 33:
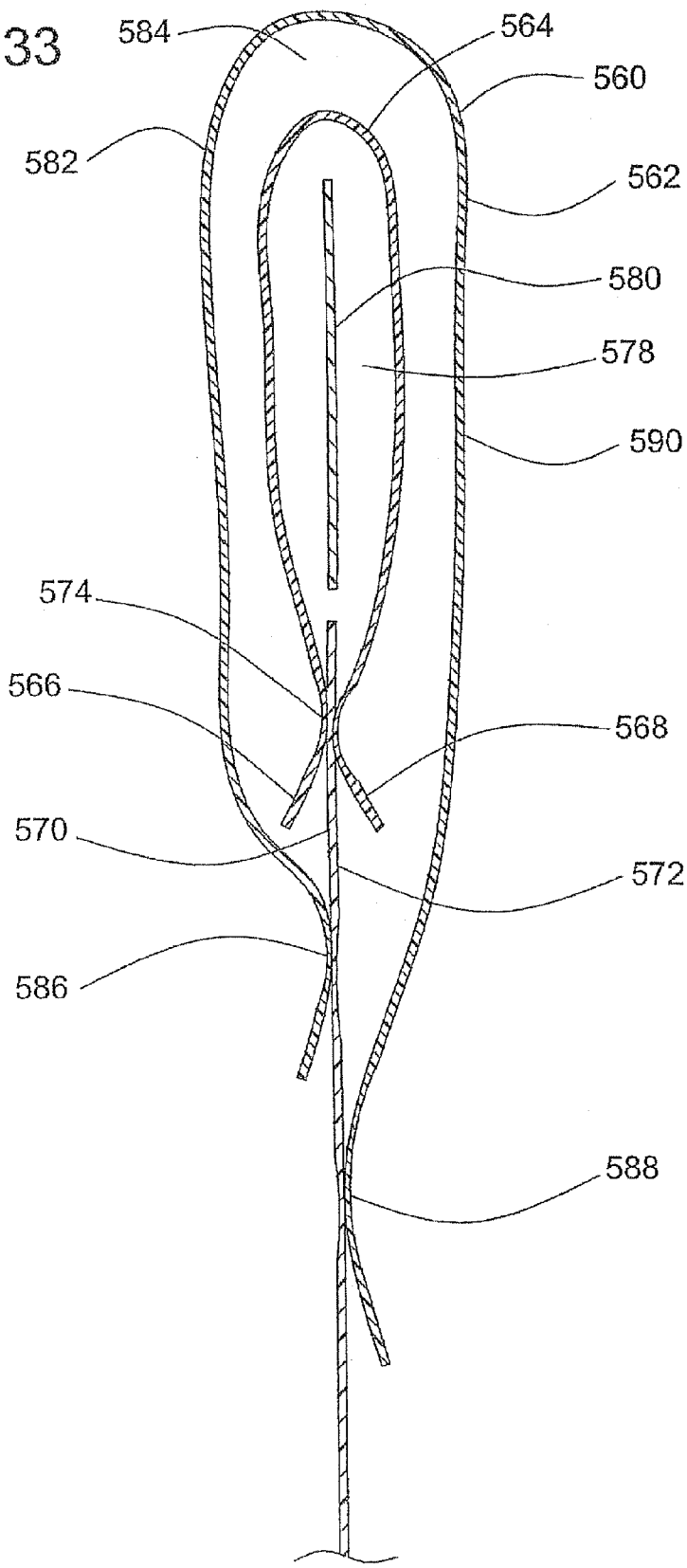
FIG. 33 is a cross sectional view of another embodiment.

Referring to FIG. 33, there is shown another embodiment. FIG. 33 shows a cross sectional view of the back wall 560 of the bag 562 wherein the front wall may be a mirror image. The bag 562 may include a first hem 564 wherein the first hem 564 is separate piece of material. Opposing ends 566, 568 of the first hem 564 may be attached to the outside 570 and inside 572 of the bag 564 along a first seal 574. The first hem 564 defines a passageway 578. A drawstring 580 may be disposed in the passageway 578. The bag 562 may include a second hem 582 defining a second passageway 584. The first hem 564 may be disposed in the second passageway 584. The second hem 582 may be attached to the outside 570 of the bag 562 along a third seal 586 and to the inside 572 of the bag 562 along a fourth seal 588, which may be lower than the third seal 586. The inside surface 590 of the second hem 582 may include a printed design. In other embodiments, the hems may have different properties than other portions of the bag such as, printed design, color, odor neutralizing agent, liquid absorbing agent, antimicrobial agent, fragrance releasing agent, thickness, strength, and/or material composition, as appropriate.

Figure 34:
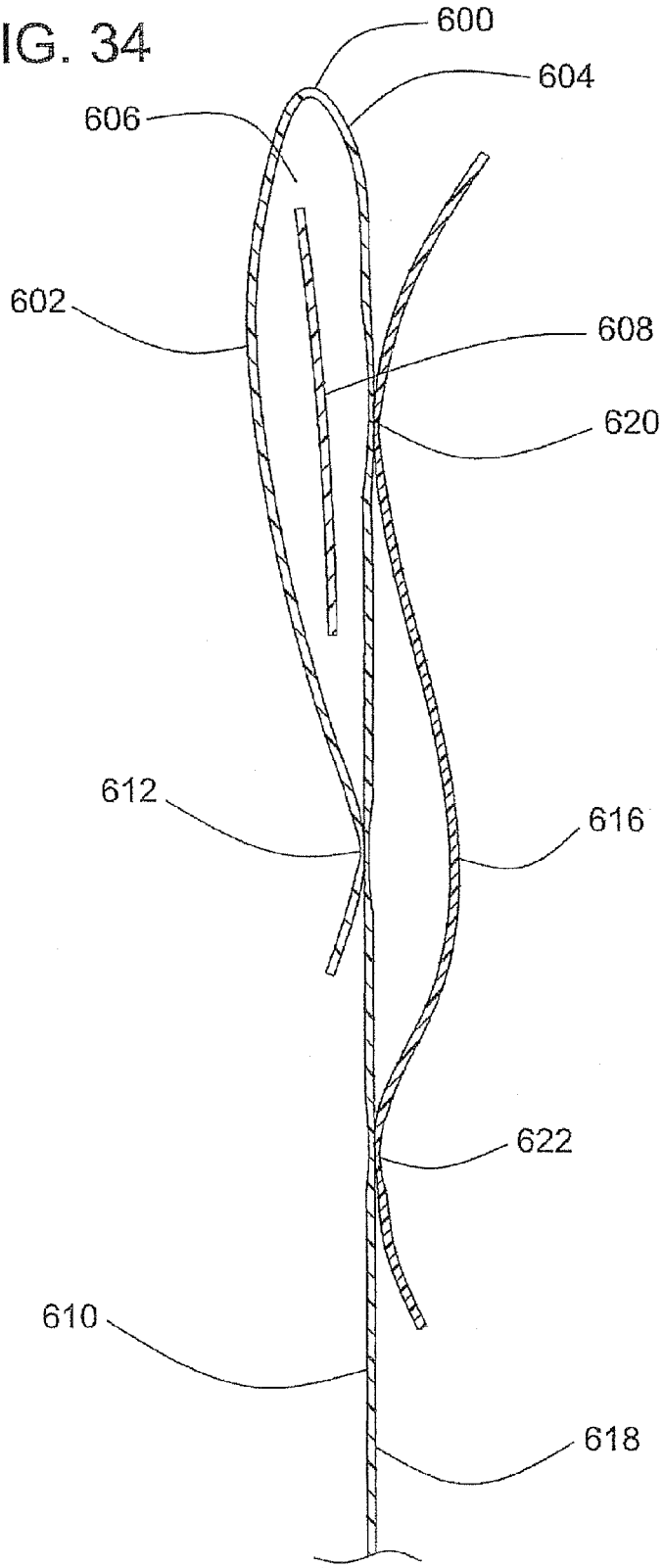
FIG. 34 is a cross sectional view of another embodiment.

Referring to FIG. 34, there is shown another embodiment. FIG. 34 shows a cross sectional view of the back wall 600 of the bag 602 wherein the front wall may be a mirror image. The bag 602 may include a hem 604 wherein the hem 604 defines a passageway 606. A drawstring 608 may be disposed in the passageway 606. The hem 604 may be attached to the outside surface 610 of the bag 602 along a first seal 612. The bag 602 may include a strip 616 joined to the inside surface 618 along a second seal 620, located on the hem 604, and a third seal 622. The strip 616 may include a printed design. In other embodiments, the strip may have different properties than other portions of the bag such as, printed design, color, odor neutralizing agent, liquid absorbing agent, antimicrobial agent, fragrance releasing agent, thickness, strength, and/or material composition, as appropriate.

Figure 35:
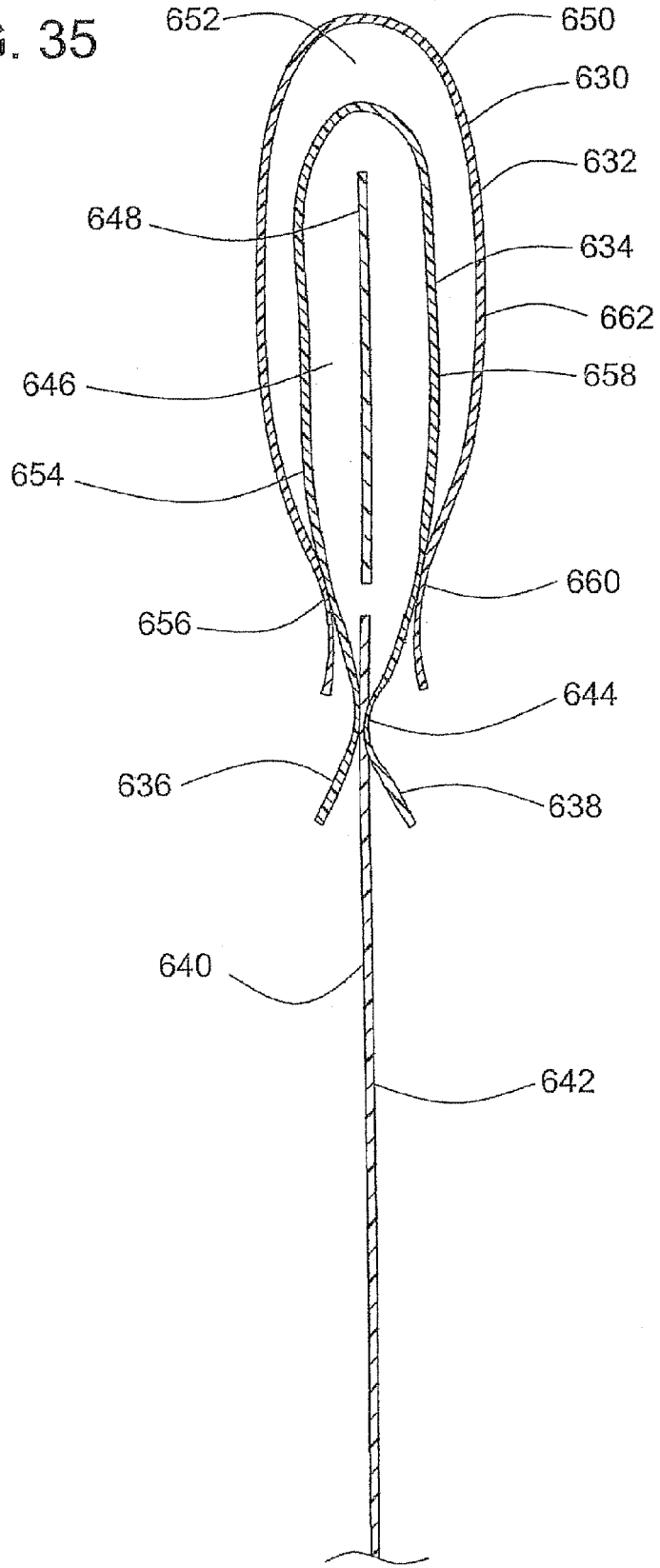
FIG. 35 is a cross sectional view of another embodiment.

Referring to FIG. 35, there is shown another embodiment of the present invention. FIG. 35 shows a cross sectional view of the back wall 630 of the bag 632 wherein the front wall may be a mirror image. The bag may include a first hem 634 wherein the first hem 634 is a separate piece of material. Opposing ends 636, 638 of the first hem 634 may be attached to the outside 640 and inside 642 of the bag 632 along a first seal 644. The first hem 634 defines a passageway 646. A drawstring 648 may be disposed in the passageway 646. The bag 632 may include a second hem 650 defining a second passageway 652. The first hem 634 may be disposed in the second passageway 652. The second hem 650 may be attached to the outside 654 of the first hem 634 along a third seal 656 and to the inside 658 of the first hem 634 along a fourth seal 660. The inside surface 662 of the second hem 650 may include a printed design. In other embodiments, the hems may have different properties than other portions of the bag such as, printed design, color, odor neutralizing agent, liquid absorbing agent, antimicrobial agent, fragrance releasing agent, thickness, strength, and/or material composition, as appropriate.

Figure 36:
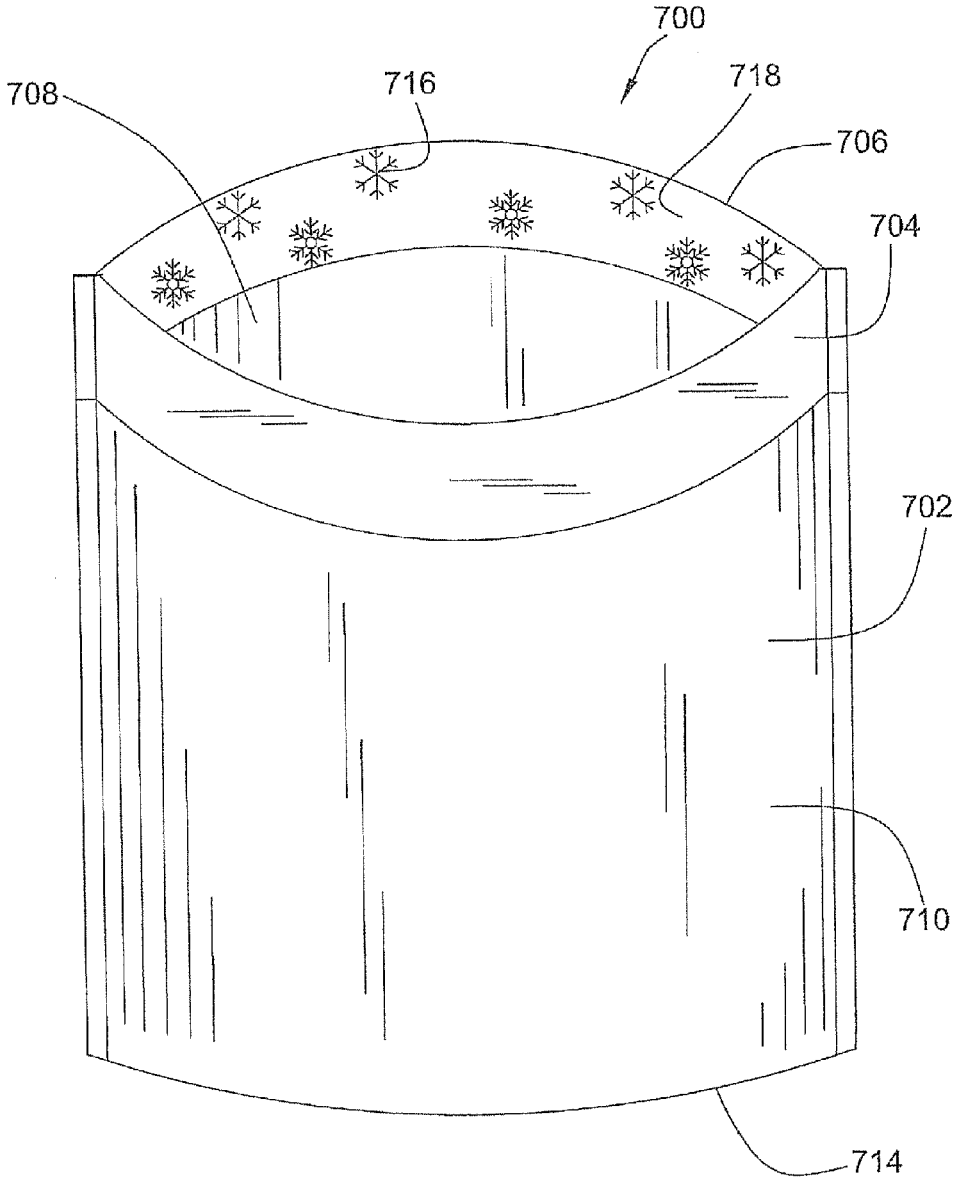
FIG. 36 is a perspective view of another embodiment.

Referring to FIG. 36, there is shown another embodiment. The bag 700 for receiving refuse comprises a bag body 702, the bag body 702 including a first portion 704. The first portion 704 includes an upper rim 706, which defines a mouth 708. The bag body 702 further includes a second portion 710 disposed below the first portion 704. The second portion 710 defines a closed bottom 714 to the bag 700. The bag body 702 may be thicker in the first portion 704 than in the second portion 710. The increased thickness of the first portion 704 improves the strength of the bag 700 at the rim 706, an area where the bag 700 may experience increased stresses due to the user holding the bag 700 at the rim 706. This increased strength in the first portion 704 of bag 700 allows for less bag failures. Because the second portion of the bag may be of relatively thinner material, the overall materials used in manufacturing the bag may be reduced. This may represent reduced costs for manufacturing the bag.

The first portion may include a printed design 716, as shown in FIG. 36. The printed design 716 may be located on the inside surface 718 of the bag. In other embodiments, the first portion may have different properties than other portions of the bag such as, printed design, color, odor neutralizing agent, liquid absorbing agent, antimicrobial agent, fragrance releasing agent, thickness, strength, and/or material composition, as appropriate. In one embodiment, the second portion may be thicker than the first portion.

Figure 37:
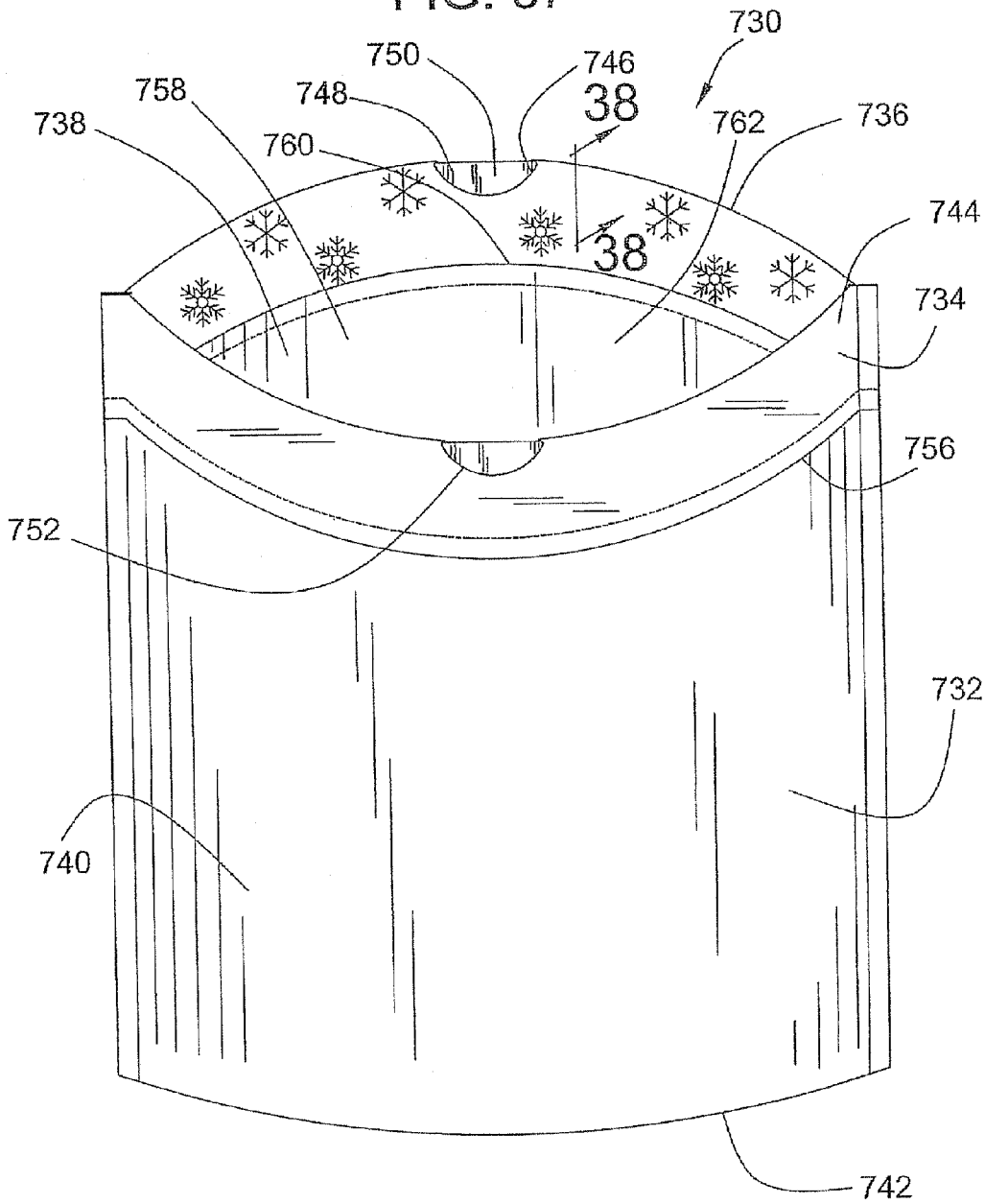
FIG. 37 is a perspective view of another embodiment.

Referring to FIG. 37, there is shown another embodiment. The bag 730 comprises a bag body 732, the bag body 732 including a first portion 734. The first portion 734 includes an upper rim 736, which defines a mouth 738. The bag body 732 further includes a second portion 740 disposed below the first portion 734. The second portion 740 defines a closed bottom 742 to the bag 730. The first portion 734 may be thicker than in the second portion 740. The bag 730 may further include a hem 744, the hem 744 defining a passageway 746. The bag 730 may have a drawstring 748 disposed within the passageway 746, the drawstring 748 being accessible at first and second openings 750, 752 in the hem 744.

The increased thickness of the first portion 734 improves the strength of the bag at the hem 744, an area where the bag 700 may experience increased stresses due to the user holding the bag 700 at the rim 736 or by the drawstring 748. This increased strength in the first portion 734 of bag allows for less bag failures. Because the second portion 740 of the bag may be of relatively thinner material, the overall materials used in manufacturing the bag may be reduced. This may represent reduced costs for manufacturing the bag.

Figure 38:
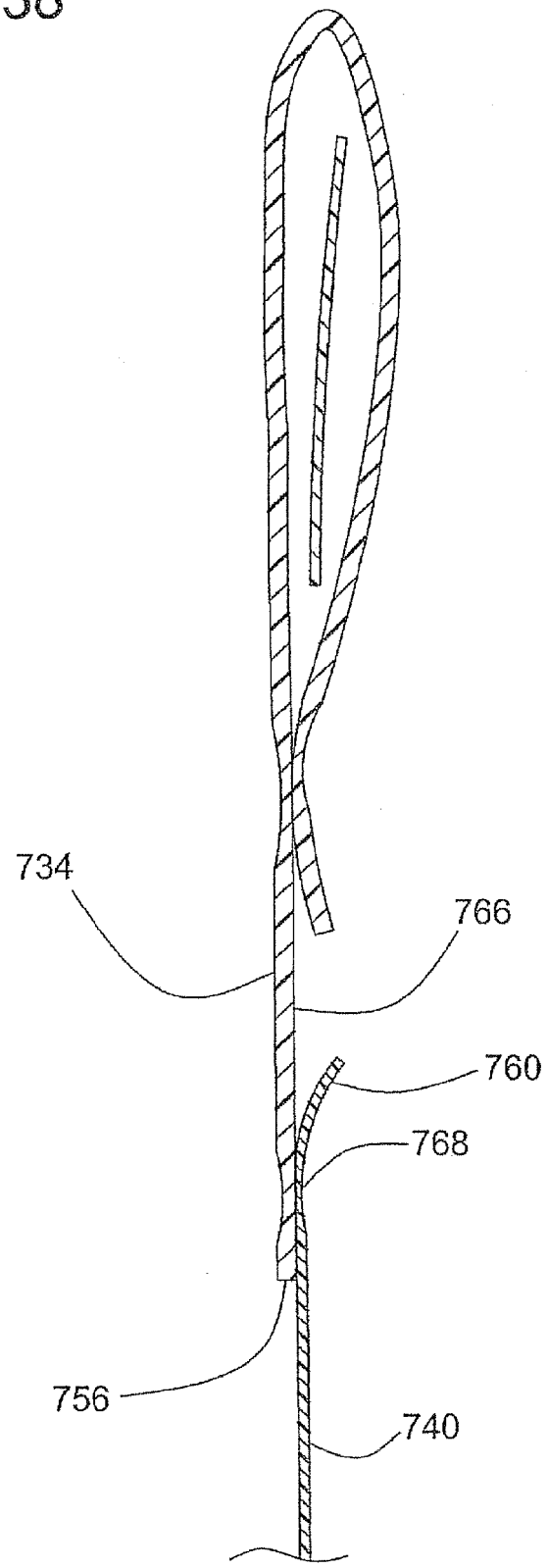
FIG. 38 is a cross sectional view taken along line 38-38 of the bag of FIG. 37.

The first portion 734 and the second portion 740 are separate pieces that have been joined together, as shown in FIG. 37. The first portion 734 includes a bottom rim 756 defining an opening 758 and the second portion 740 includes an upper rim 760 defining an opening 762. Referring to FIG. 38, the bottom rim 756 of the first portion 734 is joined to the upper rim 760 of the second portion 740 such that the mouth 738 constitutes the opening to the bag 730. The second portion 740 may be joined to the inside surface 766 of the first portion 734 along a seal 768 as shown in FIG. 38. In other embodiments, the first portion may have different properties than other portions of the bag such as, printed design, color, odor neutralizing agent, liquid absorbing agent, antimicrobial agent, fragrance releasing agent, thickness, strength, and/or material composition, as appropriate. In one embodiment, the second portion may be thicker than the first portion.

Figure 39:
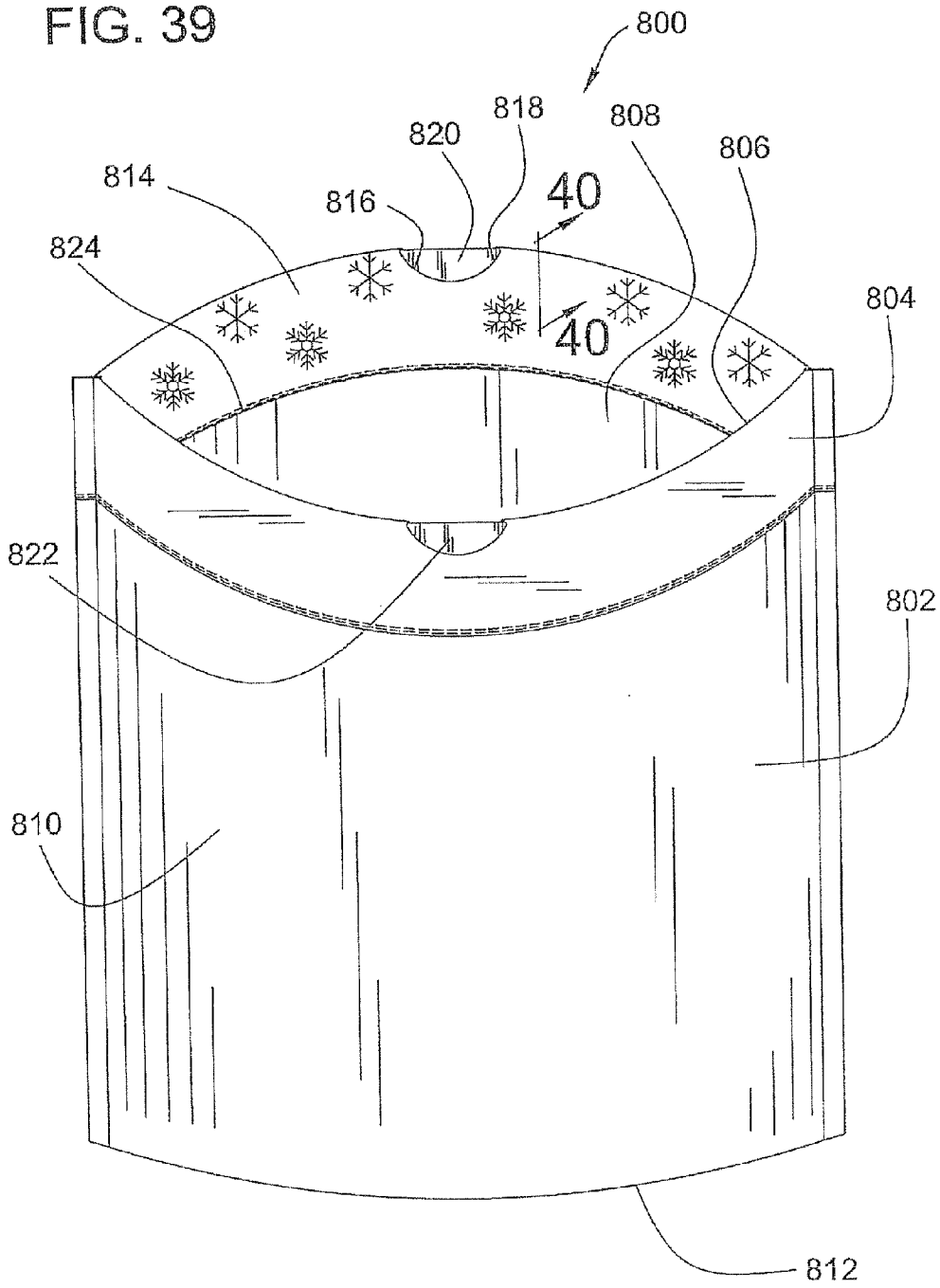
FIG. 39 is a perspective view of another embodiment.

Referring to FIG. 39, there is shown another embodiment. The bag 800 comprises a bag body 802, the bag body 802 including a first portion 804. The first portion 804 includes an upper rim 806, which defines a mouth 808. The bag body 802 further includes a second portion 810 disposed below the first portion 804. The second portion 810 defines a closed bottom 812 to the bag 800. The bag body 802 is thicker in the first portion 804 than in the second portion 810. The bag 800 may further include a hem 814, the hem 814 defining a passageway 816. The bag 800 may have a drawstring 818 disposed within the passageway 816, the drawstring 818 being accessible at first and second openings 820, 822 in the hem 814.

Figure 40:
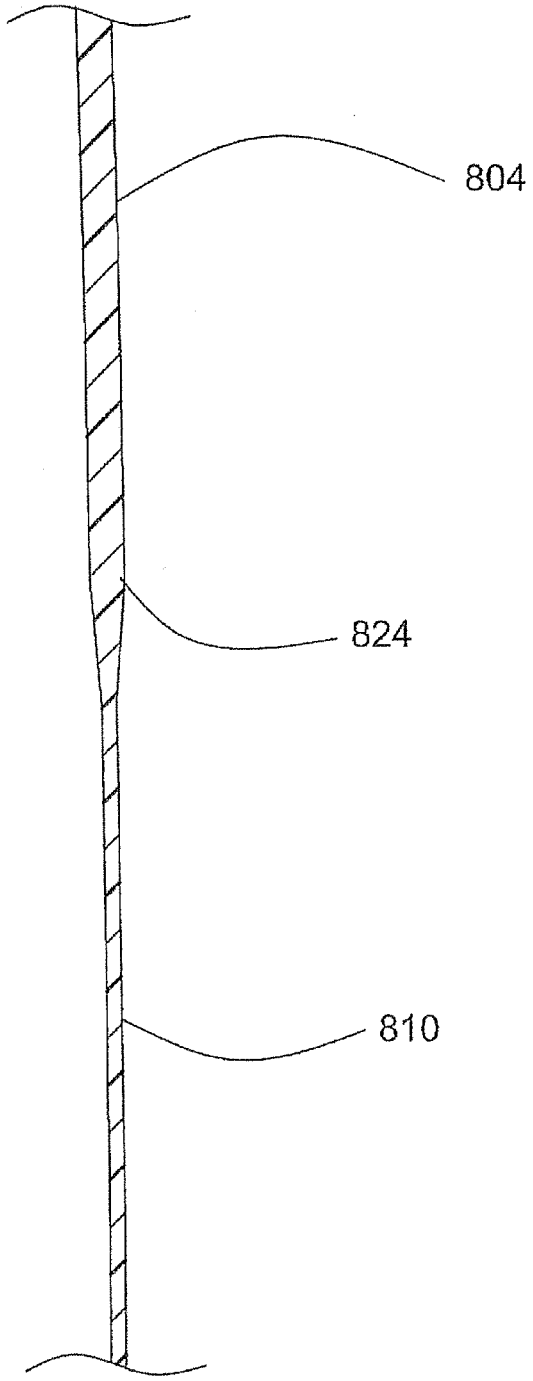
FIG. 40 is a cross sectional view taken along line 40-40 of the bag of FIG. 39.

Referring to FIGS. 39 and 40, the first portion 804 and the second portion 810 may comprise parts of the same continuous sheet of material, wherein the first portion 804 and second portion 810 are divided by a transition 824. The first portion 804 and the second portion 810 may be parts of an extruded sheet of material, wherein the part of the sheet representing the first portion 804 is extruded relatively thicker than the part of the sheet representing the second portion 810. Accordingly, the bag enjoys the benefits of being relatively thicker proximate the rim 806 and hem 814. In other embodiments, the first portion 804 may have different properties than other portions of the bag such as, printed design, color, odor neutralizing agent, liquid absorbing agent, antimicrobial agent, fragrance releasing agent, thickness, strength, and/or material composition, as appropriate. In one embodiment, the second portion may be thicker than the first portion.

Figure 41:
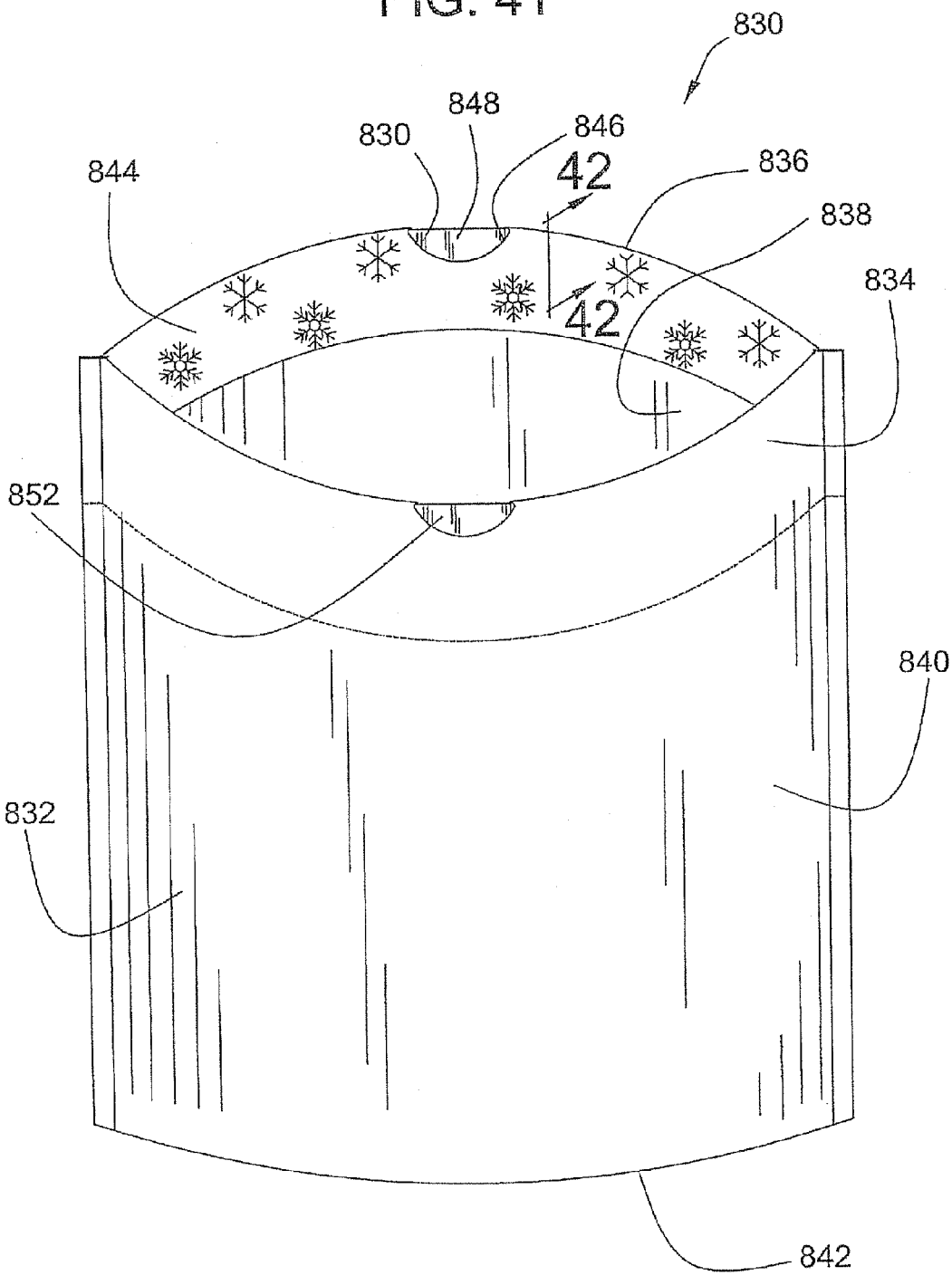
FIG. 41 is a perspective view of another embodiment.

Referring to FIG. 41, there is shown another embodiment of the present invention. The bag 830 comprises a bag body 832, the bag body 832 including a first portion 834. The first portion 834 includes an upper rim 836, which defines a mouth 838. The bag body 832 further includes a second portion 840 disposed below the first portion 834. The second portion 840 defines a closed bottom 842 to the bag 830. The bag body 832 may be thicker in the first portion 834 than in the second portion 840. The bag 830 may further include a hem 844, the hem 844 defining a passageway 846. The bag 830 may have a drawstring 848 disposed within the passageway 846, the drawstring 848 being accessible at first and second openings 850, 852 in the hem 844.

Figure 42:
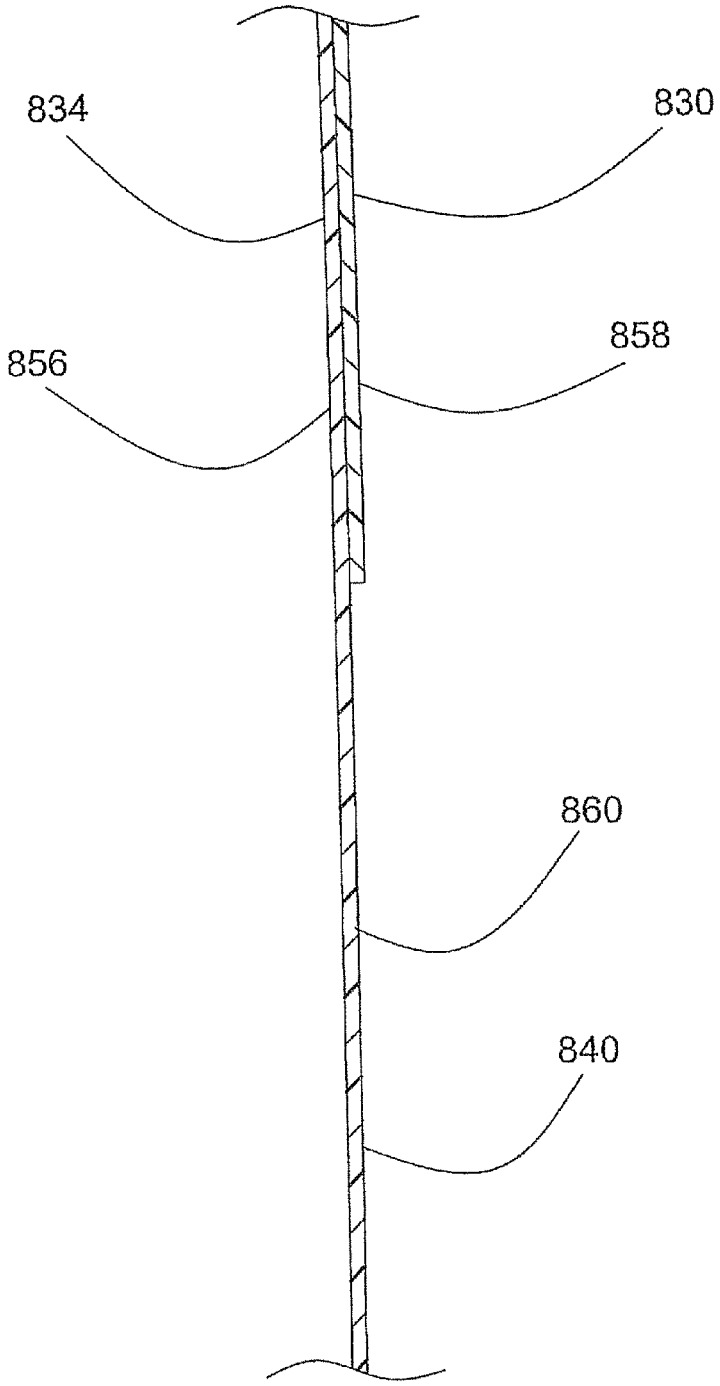
FIG. 42 is a cross sectional view taken along line 42-42 of the bag of FIG. 41.

Referring to FIG. 42, the first portion 834 may be comprised of a first layer 856 and a second layer 858. The first layer 856 and the second layer 858 are joined together to form the first portion 834. The first layer 856 of the first portion 834 and the second portion 840 may comprise parts of the same continuous sheet. The second layer 858 may be disposed on the inside surface 860 of the bag 830. Because the first portion 834 includes an extra layer, the first portion 834 is relatively thicker than the second portion 840. Accordingly, the bag 830 enjoys the benefits of being relatively thicker proximate the rim 836 and hem 844. In other embodiments, the second layer may have different properties than other portions of the bag such as, printed design, color, odor neutralizing agent, liquid absorbing agent, antimicrobial agent, fragrance releasing agent, thickness, strength, and/or material composition, as appropriate. In one embodiment, the second portion may be thicker than the first portion.

Figure 43:
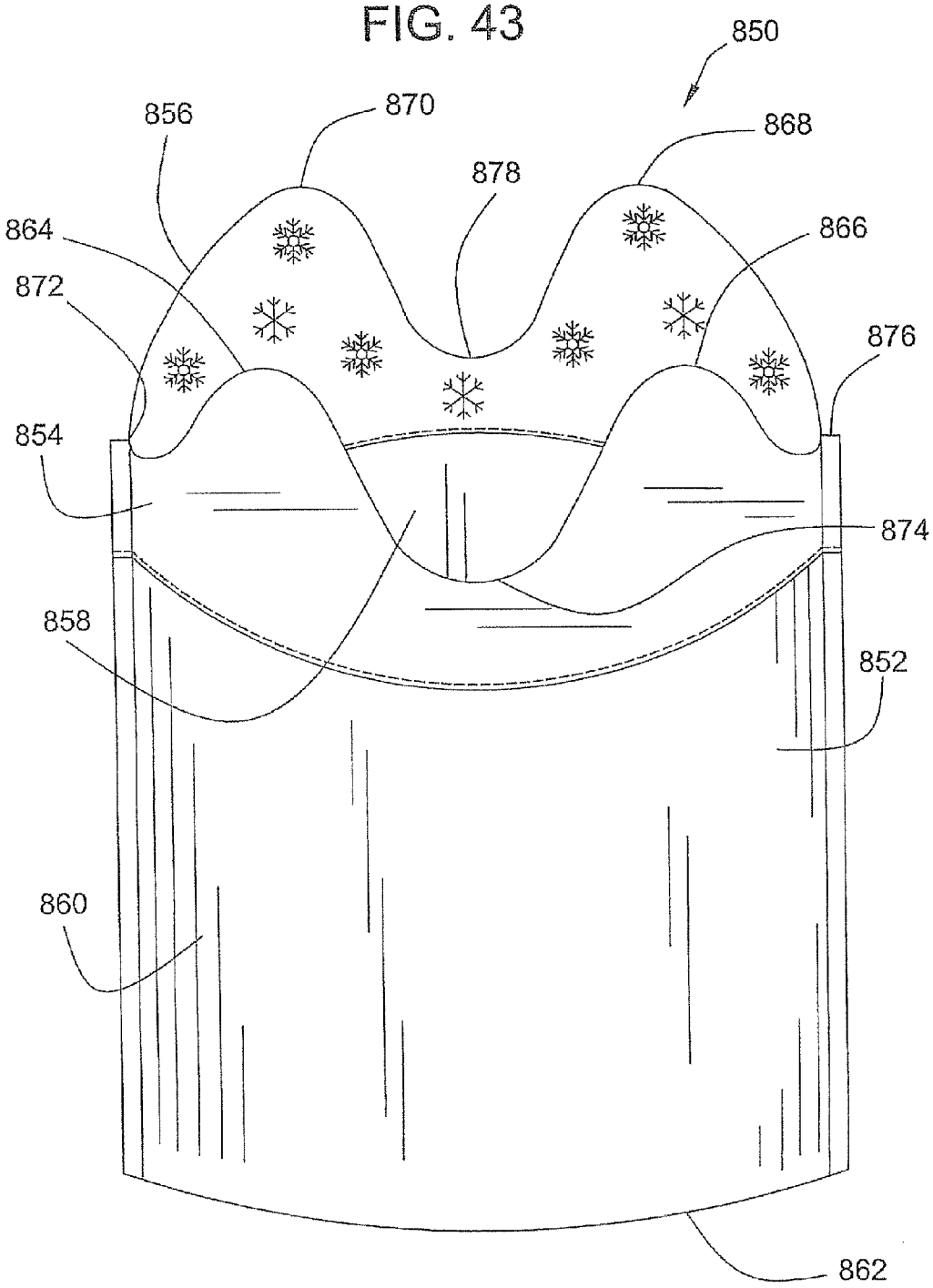
FIG. 43 is a perspective view of another embodiment.

Referring to FIG. 43, there is shown another embodiment. The bag 850 for receiving refuse comprises a bag body 852, the bag body 852 including a first portion 854. The first portion 854 includes an upper rim 856, which defines a mouth 858. The bag body 852 further includes a second portion 860 disposed below the first portion 854. The second portion 860 defines a closed bottom 862 to the bag 850. The bag body 852 may be thicker in the first portion 854 than in the second portion 860. The rim 856 of the first portion 854 may be an undulating rim. The rim 856 may include four flaps 864, 866, 868, 870. The four flaps 864, 866, 888, 870 may be separated by four valleys 872, 874, 876, 878. The flaps 864, 866, 868, 870 may be tied together to at least partially close the bag 850. In other embodiments, the bag may have two, three, five, six, seven, or eight flaps. In other embodiments, the first portion may have different properties than other portions of the bag such as, printed design, color, odor neutralizing agent, liquid absorbing agent, antimicrobial agent, fragrance releasing agent, thickness, strength, and/or material composition, as appropriate. In one embodiment, the second portion may be thicker than the first portion.

Figure 44:
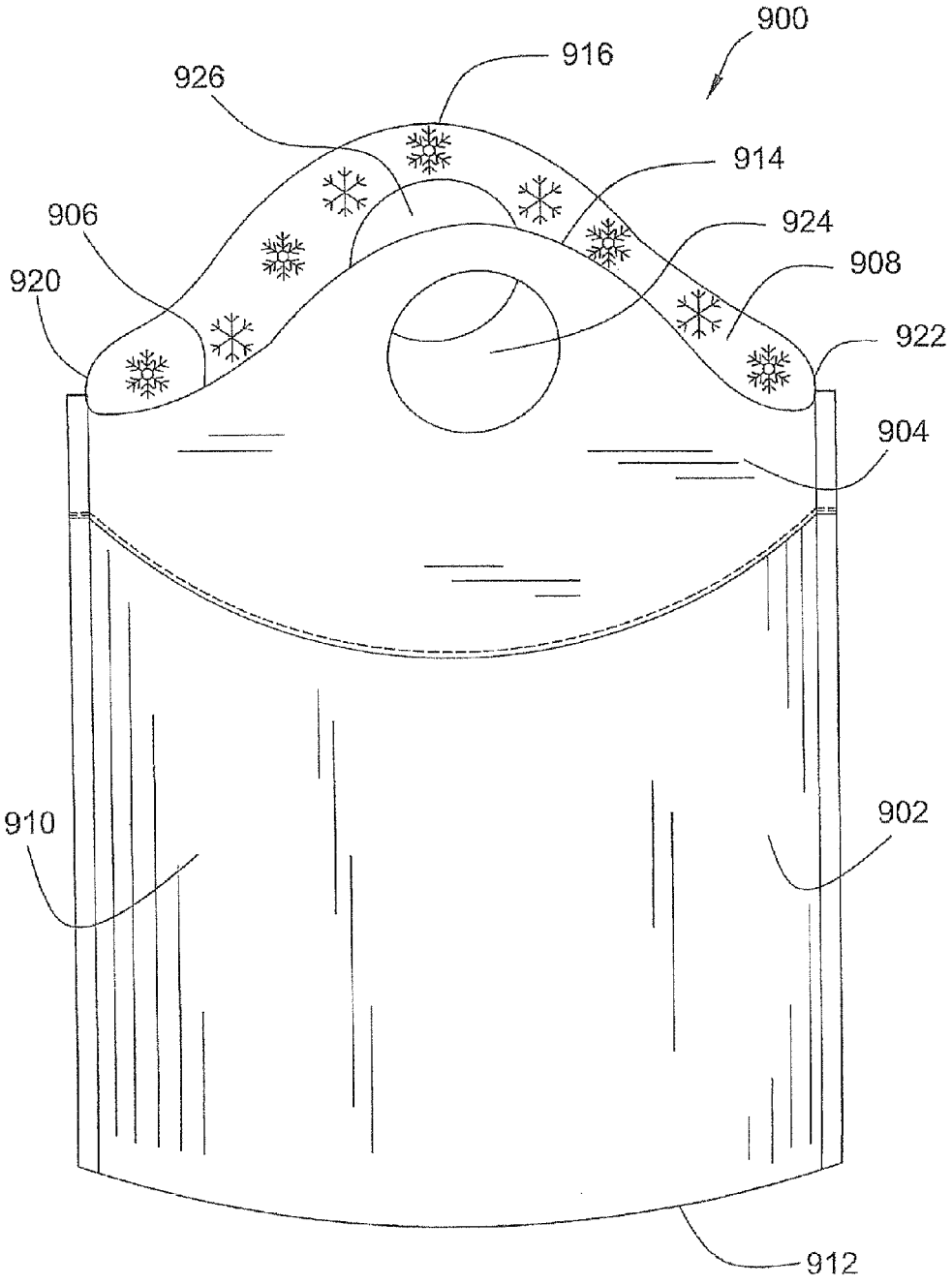
FIG. 44 is a perspective view of another embodiment.

Referring to FIG. 44, there is shown another embodiment of the present invention. The bag 900 for receiving refuse comprises a bag body 902, the bag body 902 including a first portion 904. The first portion 904 includes an upper rim 906, which defines a mouth 908. The bag body 902 further includes a second portion 910 disposed below the first portion 904. The second portion 910 defines a closed bottom 912 to the bag 900. The bag body 902 may be thicker in the first portion 904 than in the second 910 portion. The rim 906 of the first portion 904 may be an undulating rim. The rim 906 may include two flaps 914, 916. The two flaps 914, 916 may be separated by two valleys 920, 922. The two flaps 914, 916 may each include a hole 924, 926 that passes therethrough. The holes 924, 926 may be used to carry the bag before and/or after the flaps are tied together. In other embodiments, the bag may have two, three, five, six, seven, or eight flaps with holes. In other embodiments, the first portion may have different properties than other portions of the bag such as, printed design, color, odor neutralizing agent, liquid absorbing agent, antimicrobial agent, fragrance releasing agent, thickness, strength, and/or material composition, as appropriate. In one embodiment, the second portion may be thicker than the first portion.

Figure 45:
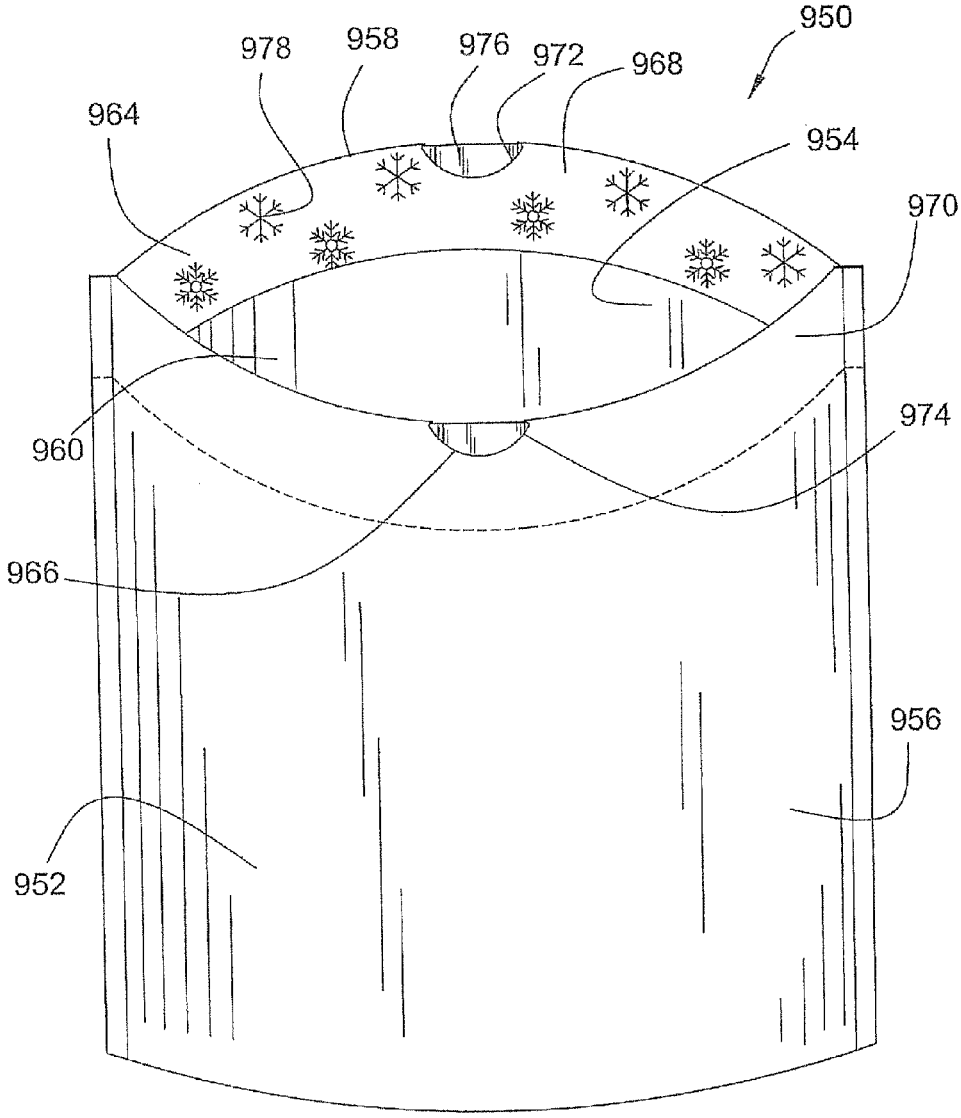
FIG. 45 is a perspective view of another embodiment.

Referring to FIG. 45, there is shown another embodiment. The bag 950 for receiving refuse comprises a bag body 952, the bag body 952 having an inside surface 954 and an outside surface 956. The bag 950 includes a rim 958, the rim 958 defining a mouth 960. The bag 950 further includes a hem 964, the hem 964 defining the rim 958. The hem 964 defines a passageway 966, the passageway 966 being at least partially enclosed. The hem 964 further includes an inside surface 968, an outside surface 970, a first opening 972, and a second opening 974. The hem 964 includes a drawstring 976, the drawstring 976 is disposed within the passageway 966. The drawstring 976 may be accessible via the first and second openings 972, 974 in the hem 964.

Figure 46:
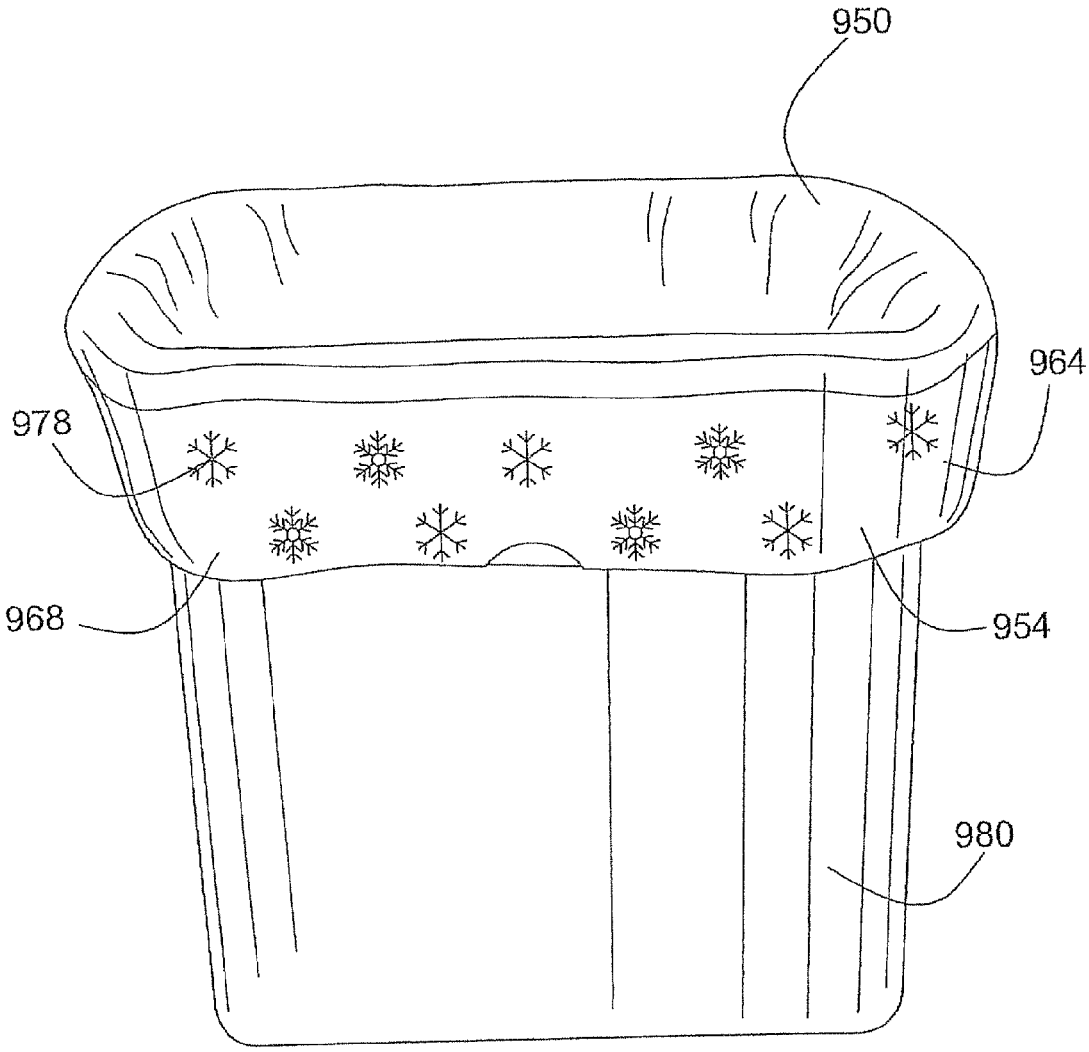
FIG. 46 is a perspective of the bag of FIG. 45 inserted into a trash receptacle.

The inside surface 968 of the hem 964 includes a printed design 978. Referring to FIG. 46, when the bag 950 is arranged inside a trash receptacle 980 such that the bag 950 is folded over the rim of the receptacle 980, the printed design 978 on the inside surface 968 of the hem 964 becomes visible.

Figure 47:
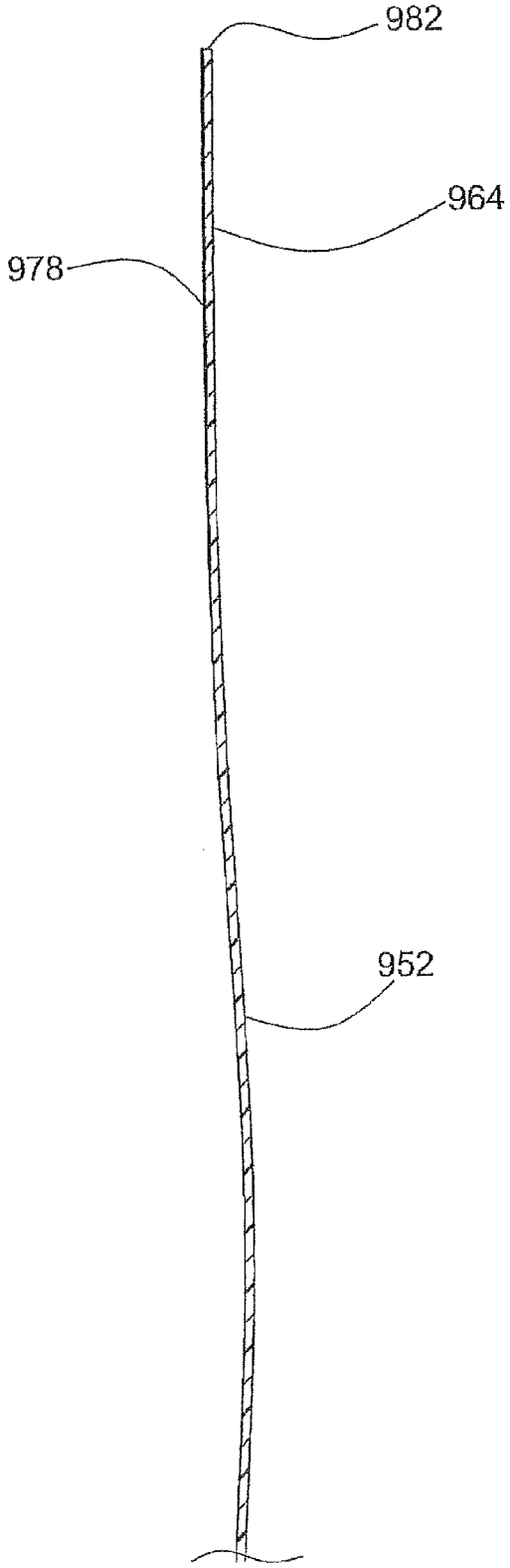
FIG. 47 is a cross sectional view of a preassembly sheet of material of the bag of FIG. 45.
Figure 48:
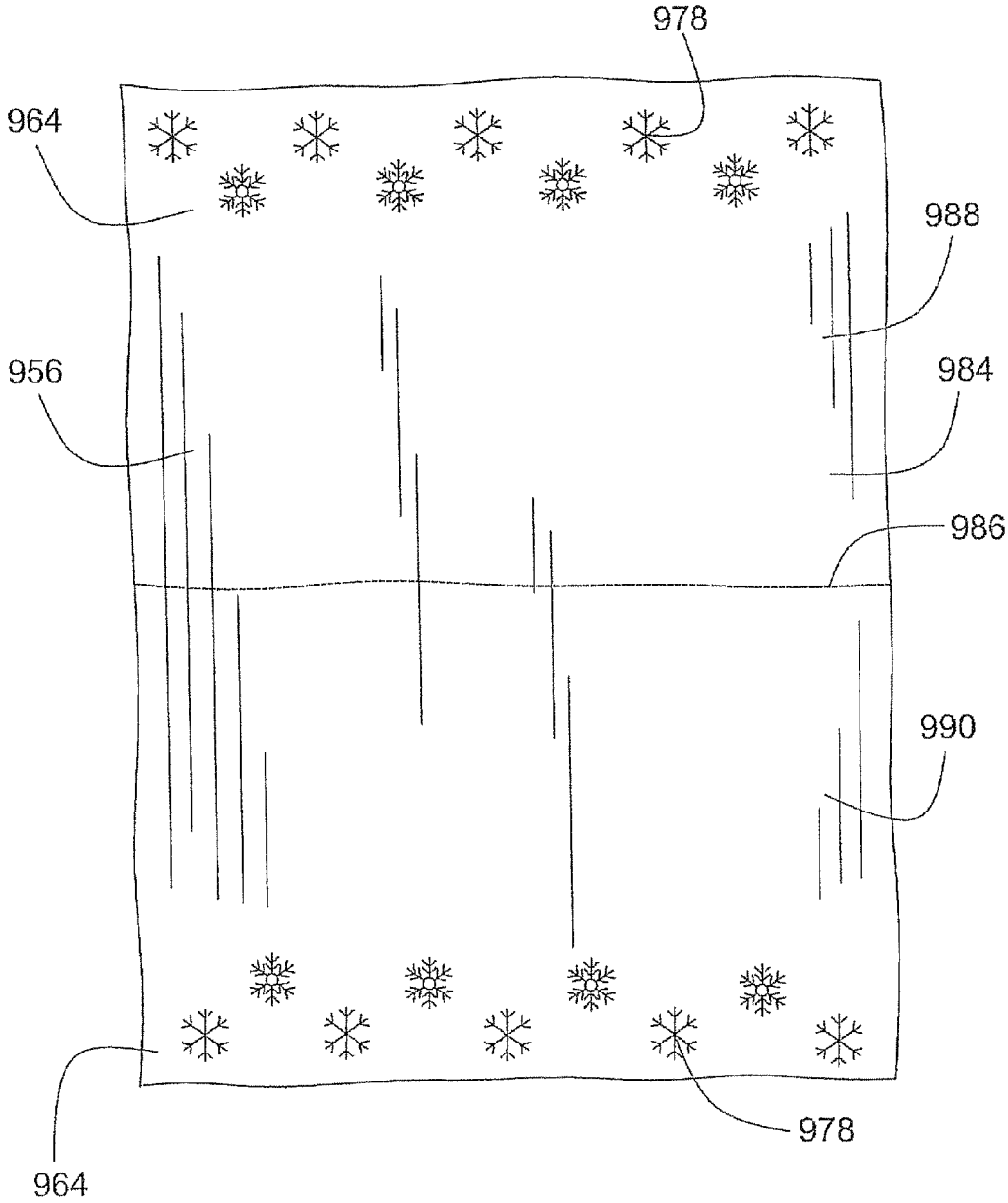
FIG. 48 is a perspective view of the sheet of FIG. 47.
Figure 49:
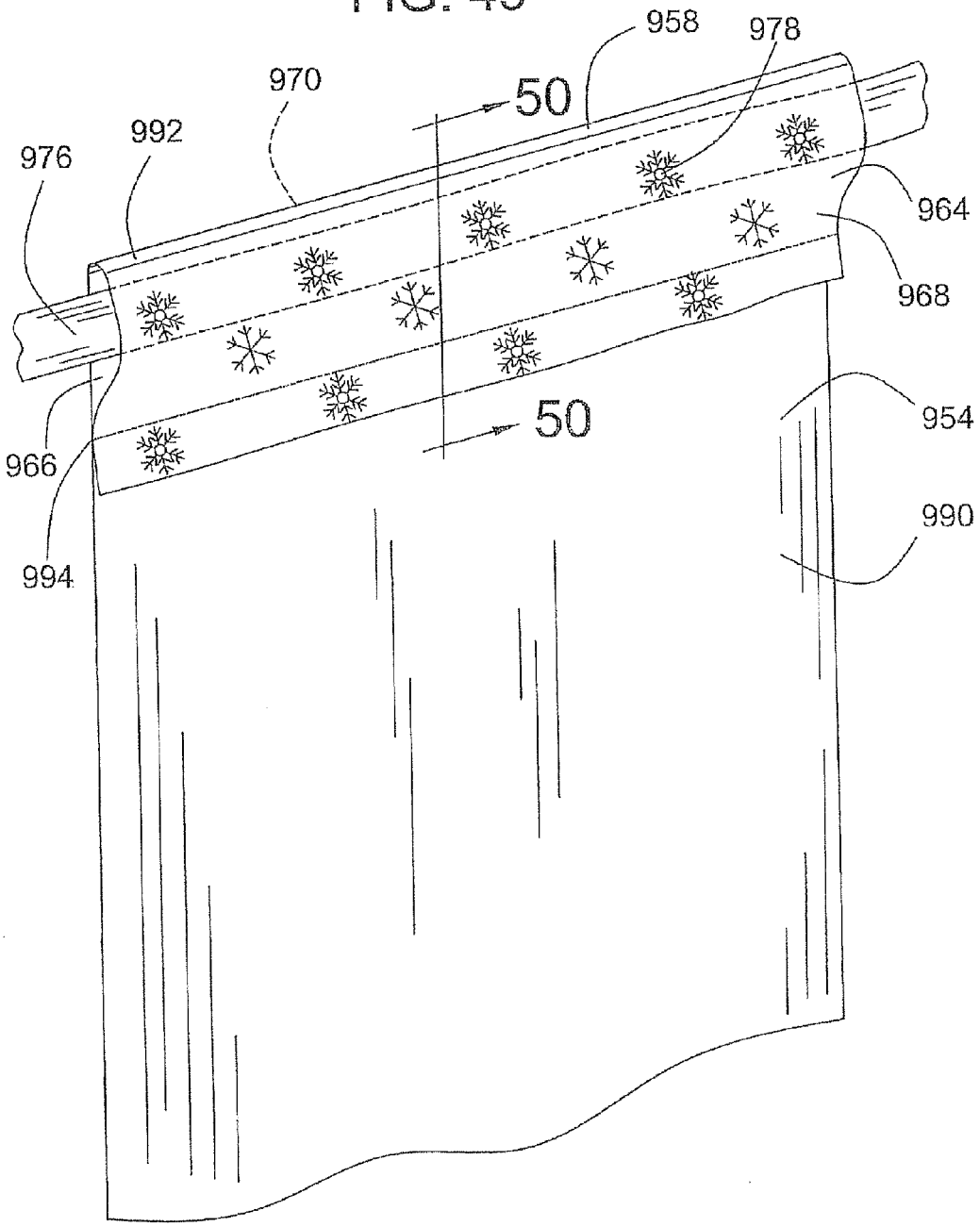
FIG. 49 is a partial perspective view of the bag of FIG. 45.
Figure 50:
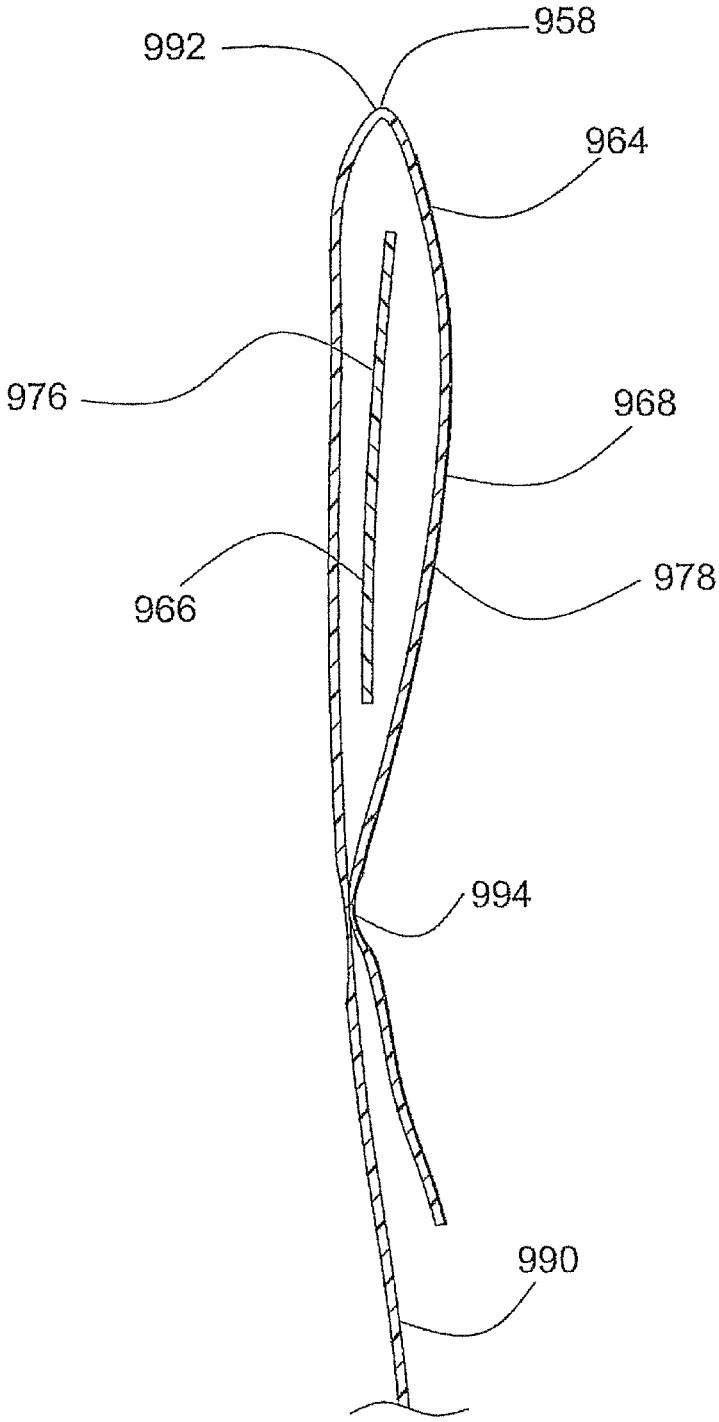
FIG. 50 is a cross sectional view taken along line 50-50 of the bag of FIG. 39.

Referring to FIGS. 47 and 48, the hem 964 and the bag body 952 are parts of the same continuous piece of material. The printed design 978 is applied to the sheet near the top edge 982. Referring to FIG. 48, the bag may be constructed from a single sheet 984 of material wherein the sheet is folded at fold 986 to form a front wall 988 and back wall 990 of the bag. Referring to FIG. 49, the hem 964 represents a fold 992 in the continuous sheet of material. When the sheet is folded at fold 992, the hem 964 is divided into an outside surface 970 and an inside surface 968, wherein the inside surface 968, now located proximate the rim 958 on the inside 954 the bag 950, includes the printed design 978, as shown in FIGS. 49 and 50. The hem 964 may be joined to the inside surface of the bag at seal 994.

Figure 51:
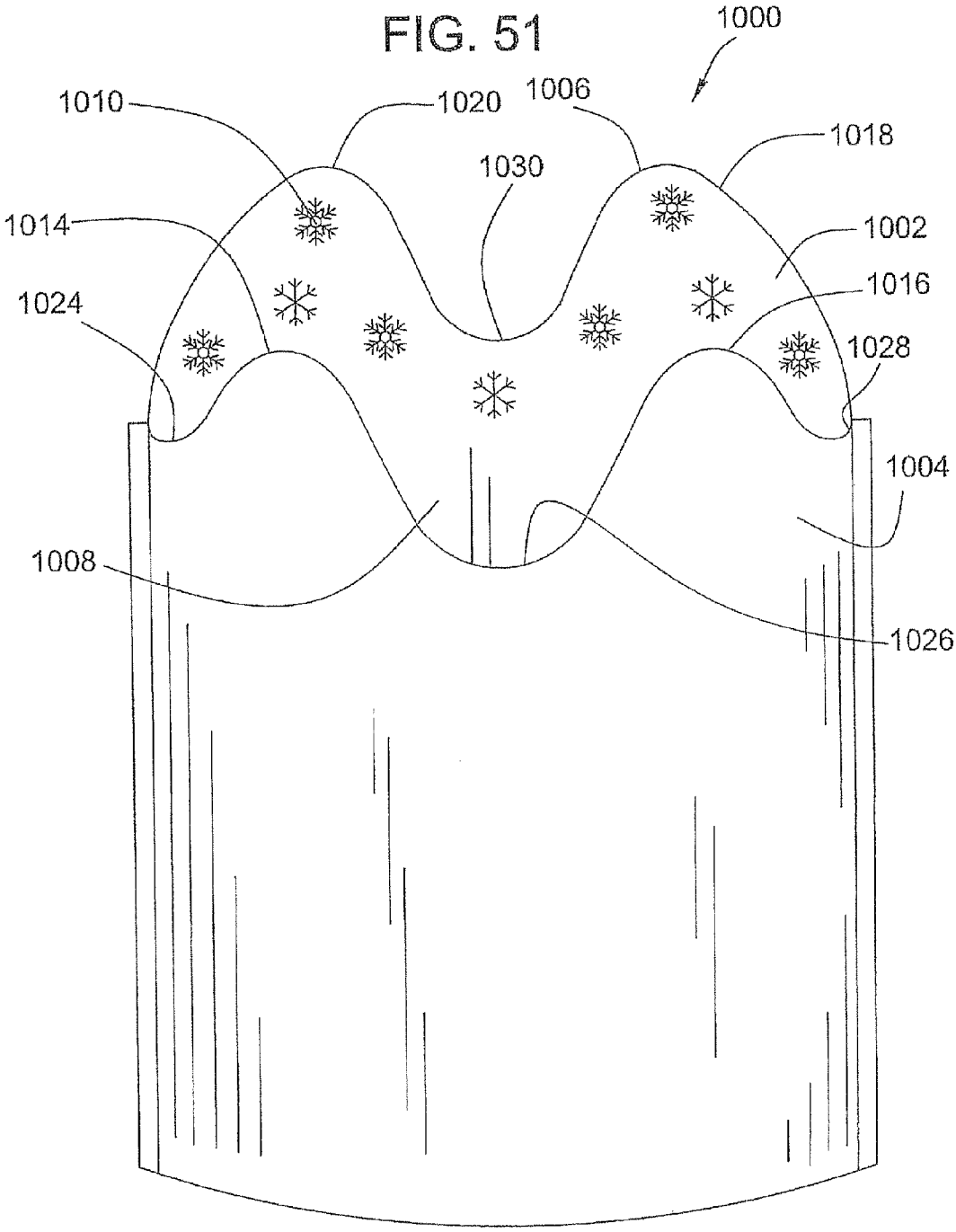
FIG. 51 is a perspective view of another embodiment.

Referring to FIG. 51, there is shown another embodiment. The bag 1000 includes an inside surface 1002, an outside surface 1004, and a rim 1006 defining a mouth 1008. The inside surface 1002 of the bag 1000 may include a printed design 1010 located near the rim 1006. When the bag 1000 is arranged inside a trash receptacle such that the bag 1000 is folded over the rim of the receptacle, the printed design 1010 on the inside 1002 of the bag becomes visible. The rim 1006 may be an undulating rim. The rim 1006 may include four flaps 1014, 1016, 1018, 1020. The four flaps 1014, 1016, 1018, 1020 may be separated by four valleys 1024, 1026, 1028, 1030. The flaps 1014, 1016, 1018, 1020 may be tied together to at least partially close the bag 1000. In other embodiments, the bag may have two, three, five, six, seven, or eight flaps.

Figure 52:
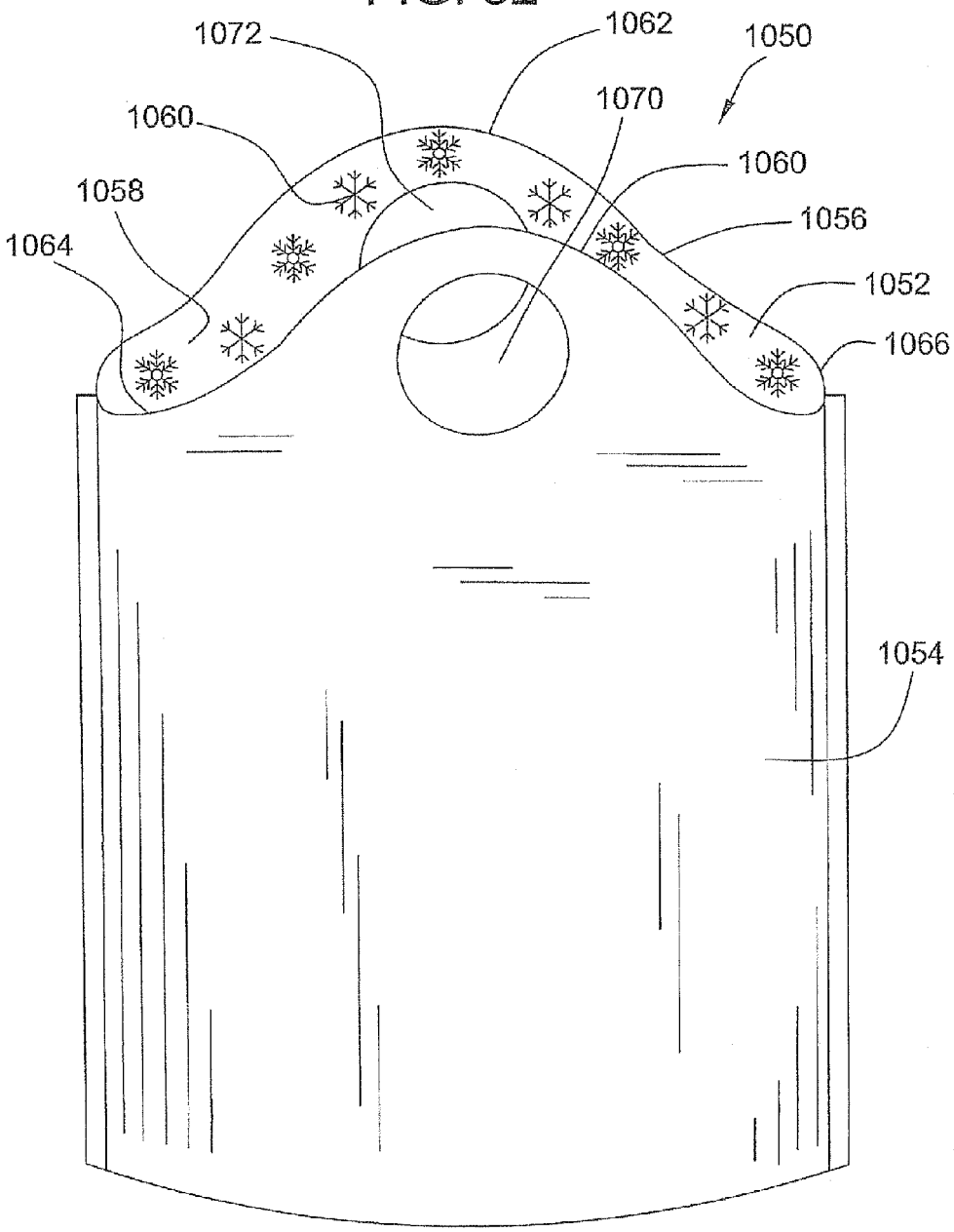
FIG. 52 is a perspective view of another embodiment.

Referring to FIG. 52, there is shown another embodiment. The bag 1050 includes an inside surface 1052, an outside surface 1054, and a rim 1056 defining a mouth 1058. The inside surface 1052 of the bag 1050 may include a printed design 1060 located near the rim 1056. When the bag 1050 is arranged inside a trash receptacle such that the bag 1050 is folded over the rim of the receptacle, the printed design 1060 on the inside 1052 of the bag 1050 becomes visible. The rim 1056 may include two flaps 1060, 1062. The two flaps 1060, 1062 may be separated by two valleys 1064, 1066. The two flaps 1060, 1062 may each include a hole 1070, 1072 that passes therethrough. The holes 1070, 1072 may be used to carry the bag before and/or after the flaps are tied together. In other embodiments, the bag may have two, three, five, six, seven, or eight flaps with holes.

Many of the above earlier embodiments may be combined with each other to create further embodiments of the bag. Accordingly, all of the features discussed in the earlier described embodiments may be included in any of the other embodiments disclosed herein, as appropriate.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A bag for receiving refuse comprising;

a bag body, the bag body including a sidewall having an inside surface, an outside surface, and a rim defining a mouth;

a hem formed by folding the sidewall and sealing the sidewall to the inside surface at a hem seal, the hem defining a passageway and including a first opening and a second opening;

a drawstring, the drawstring disposed within the passageway, the drawstring accessible via the first and second openings in the hem;

a strip of material disposed on the inside surface of the body proximate the rim, the strip including an inside surface, an outside surface that faces the inside surface of the body, a top edge, and a bottom edge;

wherein the bag body includes an embossing pattern and the strip is sealed to the inside surface of the bag body by the embossing pattern; and wherein the strip is loosely joined to the bag but remains held in place during normal use.

2. The bag of claim 1, wherein embossing pattern is an arrangement of diamond shaped regions.

3. The bag of claim 1, wherein the embossing pattern is below the hem.

4. The bag of claim 1, wherein the strip top edge remains free.

5. The bag of claim 1, wherein the embossing pattern permits the bag to stretch or yield.

6. A bag for receiving refuse comprising;

a bag body, the bag body including a sidewall having an inside surface, an outside surface, and a rim defining a mouth;

a hem formed by folding the sidewall and sealing the sidewall to the inside surface at a hem seal, the hem defining a passageway and including a first opening and a second opening;

a drawstring, the drawstring disposed within the passageway, the drawstring accessible via the first and second openings in the hem;

a strip of material disposed on the inside surface of the body, the strip including an inside surface, an outside surface that faces the inside surface of the body, a top edge, and a bottom edge;

wherein the strip is sealed to the inside surface of the bag body at a first seal below the hem seal by an embossing process.

7. The bag of claim 6, wherein the strip does not extend above the hem seal.

8. The bag of claim 6, wherein the strip includes a printed design.

9. The bag of claim 8, wherein the printed design is located on the inside surface of the strip.

10. The bag of claim 6, wherein the strip top edge remains free.

11. The bag of claim 6, wherein the embossing pattern permits the bag to stretch or yield.

12. The bag of claim 6, wherein the strip is loosely joined to the bag but remains held in place during normal use.

13. A bag for receiving refuse comprising;

a bag body, the bag body including a sidewall having an inside surface, an outside surface, and a rim defining a mouth;

a hem formed by folding the sidewall and sealing the sidewall to the inside surface at a hem seal, the hem defining a passageway and including a first opening and a second opening;

a drawstring, the drawstring disposed within the passageway, the drawstring accessible via the first and second openings in the hem;

a strip of material disposed on the inside surface of the body proximate the rim, the strip including an inside surface, an outside surface that faces the inside surface of the body;

wherein the bag body includes an embossing pattern and the strip is sealed to the inside surface of the bag body by the embossing pattern; and wherein the strip is loosely joined to the bag but remains held in place during normal use.

14. The bag of claim 13, wherein embossing pattern is an arrangement of diamond shaped regions.

15. The bag of claim 13, wherein the embossing pattern is below the hem.

16. The bag of claim 13, wherein the embossing pattern permits the bag to stretch or yield.

17. The bag of claim 13, wherein the strip includes a printed design.

18. The bag of claim 17, wherein the printed design is located on the inside surface of the strip.

* * * * *